US011332899B2

(12) United States Patent
Barker et al.

(10) Patent No.: US 11,332,899 B2
(45) Date of Patent: May 17, 2022

(54) SNOW PLOW AND MOUNT ASSEMBLY

(71) Applicant: Douglas Dynamics, L.L.C., Milwaukee, WI (US)

(72) Inventors: Chad Thomas Barker, Trevor, WI (US); David N. Bloxdorf, Hubertus, WI (US); Matthew Thoma Curran, Menomonee Falls, WI (US); Christopher A. Dominguez, New Berlin, WI (US); Matthew Terran Kaminecki, Whitefish Bay, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 0 days.

(21) Appl. No.: 16/989,056

(22) Filed: Aug. 10, 2020

(65) Prior Publication Data

US 2020/0370257 A1 Nov. 26, 2020

Related U.S. Application Data

(62) Division of application No. 15/871,557, filed on Jan. 15, 2018, now Pat. No. 10,900,183, which is a division of application No. 14/540,676, filed on Nov. 13, 2014, now Pat. No. 9,869,067.

(51) Int. Cl.
*E01H 5/06* (2006.01)

(52) U.S. Cl.
CPC ..... *E01H 5/061* (2013.01); *E01H 5/06* (2013.01)

(58) Field of Classification Search
CPC ..... E01H 5/06; E01H 5/061; E01H 5/062
See application file for complete search history.

(56) References Cited

U.S. PATENT DOCUMENTS

| | | | | |
|---|---|---|---|---|
| 2,116,351 A | | 5/1938 | Jones | |
| 2,139,625 A | | 12/1938 | Pruss | |
| 2,242,472 A | | 5/1941 | Keeler | |
| 3,104,893 A | | 9/1963 | Torrey | |
| 3,605,906 A | | 9/1971 | Coates | |
| 3,650,054 A | | 3/1972 | Hanson | |
| 3,773,116 A | | 11/1973 | Coontz | |
| 3,822,751 A | * | 7/1974 | Waterman | E02F 3/3604 172/821 |
| 3,987,562 A | | 10/1976 | Deen et al. | |
| 4,013,132 A | * | 3/1977 | Matsuzawa | E02F 3/7613 172/821 |

(Continued)

FOREIGN PATENT DOCUMENTS

| | | |
|---|---|---|
| CA | 2669270 A1 | 12/2009 |
| FR | 2 320 453 A1 | 3/1977 |

*Primary Examiner* — Jamie L McGowan
(74) *Attorney, Agent, or Firm* — Wood Herron & Evans LLP

(57) ABSTRACT

A snow plow and mount assembly has a mount frame, an A-frame, a lift frame, a plow blade, an actuator, arms, receivers, recesses, hitch pins, a latch mechanism, and a latch lever. The elements are arranged such that the vehicle is driven toward the snow plow so that the arms are received in the receivers, the actuator is energized to pivot the lift frame relative to the A-frame so that the hitch pins are received in the recesses, and the lever is moved to move the latch mechanism to the latched position. The snow plow frame is thereby removably secured to the mount frame.

12 Claims, 29 Drawing Sheets

(56) References Cited

U.S. PATENT DOCUMENTS 4,083,414 A * 4/1978 Yokoyama ..... E02F 3/7613 172/821
4,187,624 A 2/1980 Blau
4,244,429 A 1/1981 Nissen
4,279,084 A 7/1981 Low et al.
4,364,439 A 12/1982 Asal
4,439,939 A 4/1984 Blau
4,565,018 A 1/1986 Oya
4,821,436 A * 4/1989 Slocum ..... E01H 5/06 172/811
4,828,045 A 5/1989 Horsch
4,962,598 A 10/1990 Woolhiser et al.
4,962,599 A 10/1990 Harris
4,976,054 A * 12/1990 Jones ..... E01H 5/06 15/82
5,014,452 A 5/1991 Berghefer
5,031,927 A 7/1991 Frenette
5,111,603 A 5/1992 Knowlton et al.
5,195,261 A 3/1993 Vachon
5,353,530 A 10/1994 Pieper
5,447,204 A * 9/1995 Asai ..... E02F 3/7613 172/821
5,477,600 A * 12/1995 Houle ..... E01H 5/065 172/823
RE35,700 E 12/1997 Watson et al.
5,806,213 A 9/1998 Doornek et al.
5,806,214 A 9/1998 Behrens et al.
5,829,174 A 11/1998 Hadler et al.
5,894,688 A 4/1999 Struck et al.
5,924,223 A 7/1999 Hone, Jr.
5,974,702 A 11/1999 Donoghue
6,012,240 A 1/2000 Klug et al.
6,044,579 A 4/2000 Hadler et al.
6,145,222 A 11/2000 Curtis
6,151,808 A 11/2000 Curtis
6,154,986 A 12/2000 Hadler et al.
6,170,178 B1 1/2001 Christy
6,178,669 B1 1/2001 Quenzi et al.
6,209,231 B1 4/2001 Curtis
6,240,659 B1 6/2001 Curtis et al.
6,276,075 B1 * 8/2001 Kost ..... E01H 5/06 172/274
6,276,076 B1 8/2001 Quenzi et al.
6,354,024 B1 3/2002 Kost et al.
6,363,629 B1 4/2002 Curtis
6,381,880 B1 5/2002 Curtis
6,393,737 B2 5/2002 Quenzi et al.
6,408,546 B2 6/2002 Curtis
6,526,677 B1 3/2003 Bloxdorf et al.
6,594,923 B1 * 7/2003 Kost ..... E01H 5/06 37/231
6,594,924 B2 7/2003 Curtis
6,615,513 B2 9/2003 Quenzi et al.
6,618,964 B2 9/2003 Kost et al.
6,618,965 B1 9/2003 Schultz et al.
6,711,837 B2 3/2004 Bloxdorf et al.
6,775,933 B2 8/2004 Koch et al.
6,860,039 B2 3/2005 Schultz et al.
6,860,040 B2 3/2005 Schultz et al.
6,928,757 B2 * 8/2005 Bloxdorf ..... E01H 5/066 37/231
6,944,978 B2 9/2005 LeBlond et al.
7,103,995 B2 9/2006 Curtis
7,117,617 B2 10/2006 Kost et al.
7,146,754 B2 12/2006 Schultz et al.
7,171,769 B2 * 2/2007 Schultz ..... B60D 1/36 172/272
7,228,650 B2 6/2007 Curtis
7,260,902 B2 8/2007 Curtis
7,290,359 B2 11/2007 Potak
7,353,628 B2 4/2008 Potak
7,430,821 B2 10/2008 LeBlond et al.
7,448,453 B2 * 11/2008 Tobin ..... E02F 3/7627 172/817
7,472,499 B2 1/2009 Schmeichel
7,513,069 B1 4/2009 Gamble, II et al.
7,526,883 B2 5/2009 Musso, Jr. et al.
7,562,718 B1 7/2009 Moorman et al.
7,565,756 B2 7/2009 Almadani
7,574,820 B2 8/2009 Musso, Jr. et al.
7,596,892 B2 * 10/2009 Ruuska ..... E01H 5/065 37/266
7,661,211 B2 2/2010 Potak
7,681,334 B2 3/2010 LeBlond et al.
7,743,535 B2 6/2010 Goodman et al.
7,797,859 B2 9/2010 LeBlond et al.
7,841,109 B2 11/2010 Stevens et al.
7,841,110 B2 11/2010 Koch et al.
7,877,834 B2 2/2011 Kallman et al.
7,963,052 B2 6/2011 Koch et al.
8,065,822 B2 * 11/2011 Maas ..... E01H 5/061 37/231
8,069,590 B2 12/2011 Schmeichel
8,220,560 B1 7/2012 Laudenklos
8,286,374 B2 10/2012 Dilworth et al.
8,291,622 B2 10/2012 Gappy
8,453,358 B2 * 6/2013 Ropog ..... E01H 5/063 37/231
8,528,237 B1 9/2013 Bacall
8,763,280 B1 * 7/2014 Fournier ..... E01H 5/06 37/235
8,763,715 B2 7/2014 Osgood
8,776,405 B2 7/2014 Paonessa
9,347,199 B2 * 5/2016 Gendron ..... E01H 5/066
9,765,492 B2 9/2017 Beaird, III
9,869,067 B2 1/2018 Barker et al.
2004/0074115 A1 4/2004 Curtis
2004/0172858 A1 9/2004 Bloxdorf et al.
2005/0120595 A1 6/2005 Bloxdorf et al.
2006/0055150 A1 3/2006 Curtis
2006/0107555 A1 5/2006 Curtis
2008/0073090 A1 3/2008 Harris
2008/0115391 A1 5/2008 Musso et al.
2008/0115392 A1 5/2008 Musso et al.
2009/0307937 A1 12/2009 Koch et al.
2012/0285050 A1 11/2012 Osgood
2013/0185962 A1 7/2013 Reeves et al.
2013/0212913 A1 8/2013 Despres
2013/0248211 A1 * 9/2013 Warchola ..... E02F 3/7627 172/1
2014/0064826 A1 * 3/2014 Clifford ..... B66C 23/44 403/53
2014/0230290 A1 * 8/2014 Bloxdorf ..... E01H 5/067 37/281
2018/0371720 A1 12/2018 Jewell et al.

* cited by examiner

SNOW PLOW AND MOUNT ASSEMBLY

RELATED APPLICATIONS

This application is a divisional of U.S. patent application Ser. No. 15/871,557 filed Jan. 15, 2018, which is a divisional of U.S. patent application Ser. No. 14/540,676 filed Nov. 13, 2014, now U.S. Pat. No. 9,869,067 issued Jan. 16, 2018, both of which are hereby incorporated by reference herein as if fully set forth in their entirety.

FIELD OF THE INVENTION

This invention relates generally to plows, and more particularly to improvements in snow plow and mount assemblies as well as to improvements in snow plows themselves.

BACKGROUND OF THE INVENTION

Conventional pickup truck mounted snow plow assemblies have a mount frame that attaches to the truck frame below and behind the front bumper, and a snow plow frame that removably attaches to the mount frame. When not in use the snow plow frame is detached from the mount frame and stored; the mount frame remains on the truck frame but is generally unobtrusive as it is below and behind the front bumper.

A conventional snow plow frame has a lift frame and an A-frame. The lift frame removably attaches at its lower ends to the mount frame, and generally extends forwardly and upwardly from the mount frame. The A-frame is pivoted at its rearward end to the lower ends of the lift frame for pivoting about a transverse horizontal lift axis. A plow blade is pivoted to the A-frame at its forward end for pivoting about a vertical axis. Hydraulic cylinders are attached on one end to the blade and on the other end to the A-frame to pivot the blade about the vertical axis. The plow blade may also be pivoted to the A-frame for pivoting about a transverse horizontal blade trip axis, in the event that the snow plow employs a blade trip, or alternatively, a lower edge of the blade may be pivoted to the balance of the blade for pivoting about a transverse horizontal edge trip axis, in the event that the snow plow employs an edge trip. A hydraulic cylinder is operable between the lift frame and the A-frame to pivot the A-frame about the transverse horizontal lift axis and hence raise and lower the blade. There are at least two different types of lift arrangements.

One type of lift arrangement has a hydraulic cylinder attached on one end to the lift frame and attached on the other end to the A-frame. In this arrangement, retracting the cylinder directly raises the A-frame and blade, and extending the cylinder directly lowers the A-frame and blade. The other type of lift arrangement has a lift arm pivoted to the lift frame, a chain or cable or other tethering device attached on one end to the free end of the lift arm and attached on the other end to the A-frame, and a hydraulic cylinder attached on one end to the lift frame and attached on the other end to the lift arm. In this arrangement, extending the cylinder raises the A-frame and blade via the lift arm and chain, and retracting the cylinder lowers the A-frame and blade via the lift arm and chain.

Over the years a number of different hitching mechanisms have been proposed to allow an operator to more quickly and easily hitch the snow plow frame to the mount frame. Some examples of hitch assemblies are shown in the assignee's U.S. Pat. Nos. Re. 35,700, 6,928,757, 6,711,837, 6,526,577, 5,353,530, 7,797,859, 7,681,334, 7,430,821, 6,944,978, 6,615,513, 6,393,737, 6,276,076, and 6,178,669, the disclosures of which are hereby incorporated by reference herein as if fully set forth in their entirety.

Despite the advances made in the area of hitching mechanisms over the years, further improvement is nevertheless desired, as it also is for snow plows in general.

SUMMARY OF THE INVENTION

One embodiment of a snow plow and mount assembly provided herein comprises a mount frame adapted to be secured to a vehicle, and snow plow frame having an A-frame and a lift frame pivotally connected relative to one another for pivoting movement about a generally transverse horizontal axis, a plow blade pivotally connected relative to the A-frame for pivoting movement about a generally vertical axis, and an actuator operably associated with the A-frame and the lift frame for imparting relative pivoting movement between the A-frame and the lift frame. One of the mount frame and the lift frame has first and second arms and the other of the mount frame and the lift frame has first and second receivers. Each arm has a recess in an end thereof. Each receiver has a hitch pin therein. The first and second arms are received in respective ones of the first and second receivers upon relative movement therebetween towards one another. The hitch pins are received in respective ones of the recesses upon relative movement therebetween towards one another. The lift frame has first and second latch pins and a latch lever operably associated with the latch pins for moving the latch pins to a latched position where respective ones of the latch pins secure the arms in the receivers, and for moving the latch pins to an unlatched position where the arms are free to move out of the receivers. The vehicle is driven toward the snow plow so that the arms are received in the receivers. The actuator is energized to pivot the lift frame relative to the A-frame in a first direction such that the hitch pins are received in the recesses. The lever is moved to move the latch pins to the latched position. The snow plow frame is thereby removably secured to the mount frame.

A hole can be provided in each arm and a corresponding hole can be provided in each receiver, for each latch pin. When the actuator is energized to further pivot the lift frame relative to the A-frame in the first direction, after the hitch pins are received in the recesses, the arm holes are aligned with the receiver holes. At that time the lever is moved to move the latch pins to the latched position thereby positioning the latch pins in the arm holes and in the receiver holes. A linkage mechanism can be used to interconnect the latch pins, the lever, and the link.

Another embodiment of a snow plow and mount assembly provided herein comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, and an actuator operably associated with the A-frame and the lift frame for imparting relative pivoting movement between the A-frame and the lift frame. One of the mount frame and the lift frame has first and second arms and the other of the mount frame and the lift frame has first and second receivers. The first and second arms are received in respective ones of the first and second receivers upon relative movement therebetween towards one another. A support stand is movably mounted to the A-frame for movement to an extended ground contacting and snow plow frame supporting position and to a retracted position at which the stand does not contact the ground and does not support the snow plow frame. The support stand is moved to the retracted position in response to the lift frame being pivoted relative to the A-frame in a first direction by the actuator, and the support stand is moved to the extended position in response to the lift frame being pivoted relative to the A-frame in a second direction by the actuator.

The support stand can be pivoted to the A-frame. The lift frame can have first and second latch pins and a latch lever operably associated with the latch pins for moving the latch pins to a latched position where respective ones of the latch pins secure the arms in the receivers, and for moving the latch pins to an unlatched position where the arms are free to move out of the receivers. The support stand can be biased toward the retracted position, and a link can be pivotally connected to the lift frame for pivoting movement between a deployed position and a stowed position. The link, stand, and lever can be operably associated such that, when the lever is moved to move the latch pins to the unlatched position the link moves to the deployed position; when the actuator is energized to pivot the lift frame relative to the A-frame in the second direction, the link contacts the support stand whereupon further pivoting of the lift frame relative to the A-frame in the second direction moves the support stand to the deployed position; when the actuator is energized to pivot the lift frame relative to the A-frame in the first direction, the support stand returns to the retracted position; and, when the lever is moved to move the latch pins to the latched position, the link moves to the stowed position. Alternatively, a cam actuating pin can be movably connected to the lift frame for translational movement between a deployed position and a stowed position. The cam actuating pin can be operably associated with a cam surface of the stand, and the lever can be operably associated with the cam actuating pin such that, when the lever is moved to move the latch pins to the unlatched position the cam actuating pin moves to the deployed position, and when the actuator is energized to pivot the lift frame relative to the A-frame in the second direction the cam actuating pin contacts the cam surface of the stand whereupon further pivoting of the lift frame relative to the A-frame in the second direction moves the support stand to the deployed position, and when the actuator is energized to pivot the lift frame relative to the A-frame in the first direction the support stand returns to the retracted position, and when the lever is moved to move the latch pins to the latched position the cam actuating pin moves to the stowed position.

Another embodiment of a snow plow and mount assembly provided herein comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis and about a generally longitudinal horizontal axis, and an actuator operably associated with the A-frame and the lift frame for imparting relative pivoting movement between the A-frame and the lift frame. One of the mount frame and the lift frame has first and second arms and the other of the mount frame and the lift frame has first and second receivers. The first and second arms are received in respective ones of the first and second receivers upon relative movement therebetween toward one another. A two part push beam has a forward portion and a rearward portion. The blade is mounted to the forward push beam portion. The rearward push beam portion is pivotally connected to the A-frame for pivoting movement about the generally vertical axis. The forward and rearward push beam portions are pivotally connected to one another for pivoting movement about the generally longitudinal horizontal axis.

A resilient member, for example leaf spring, can be operably associated with the pivotal connection of the forward push beam portion to the rearward push beam portion to impart a degree of stiffness to the pivotal connection. The forward and rearward push beam portions can include cooperating limit structure for limiting a magnitude of pivoting movement that the forward push beam portion can pivot relative to the rearward push beam portion.

Another embodiment of a snow plow and mount assembly provided herein comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, and an actuator operably associated with the A-frame and the lift frame for imparting relative pivoting movement between the A-frame and the lift frame. One of the mount frame and the lift frame has first and second arms and the other of the mount frame and the lift frame has first and second receivers. The first and second arms are received in respective ones of the first and second receivers upon relative movement therebetween toward one another. A trunnion and the A-frame are pivotally connected to one another for pivoting movement about a generally longitudinal horizontal axis, and the lift frame and trunnion are pivotally connected to one another for pivoting movement about the generally transverse horizontal axis. A resilient member is operably associated with the pivotal connection of the trunnion and the A-frame to impart a degree of stiffness to the pivotal connection.

The resilient member can be a leaf spring, for example.

Another embodiment of a snow plow and mount assembly provided herein comprises a mount frame adapted to be secured to a vehicle, a snow plow frame having an A-frame and a lift frame pivotally connected relative to one another for pivoting movement about a generally transverse horizontal axis, a plow blade pivotally connected relative to the A-frame for pivoting movement about a generally vertical axis, and an actuator operably associated with the A-frame and the lift frame for imparting relative pivoting movement between the A-frame and the lift frame. One of the mount frame and the lift frame has first and second arms and the other of the mount frame and the lift frame has first and second receivers, each arm having a recess in an end thereof, each receiver having a hitch pin therein, the first and second arms received in respective ones of the first and second receivers upon relative movement therebetween toward one another, the hitch pins received in respective ones of the recesses upon relative movement therebetween toward one another. The lift frame has a latch mechanism movable to a latched position for securing the arms in the receivers and movable to an unlatched position for freeing the arms to move out of the receivers. The assembly is operable such that when the vehicle is driven towards the snow plow the arms are received in the receivers, when the actuator is energized to pivot the lift frame relative to the A-frame in a first direction the hitch pins are received in the recesses, and when the latch mechanism is moved to the latched position the snow plow frame is removably secured to the mount frame.

For all of the various embodiments provided herein, the arms can be on the lift frame and the receivers can be on the mount frame, and the actuator can be a hydraulic cylinder connected to the A-frame and to the lift frame. Further, for all of the various embodiments provided herein, a single arm and a single receiver can be used, with the arm on one of the lift frame and the mount frame and the receiver on the other of the lift frame and the mount frame. And, the various embodiments can be used together in any combination or subcombination thereof.

The accompanying drawings, which are incorporated in and constitute a part of this specification, illustrate embodiments of the invention and, together with the summary of the invention given above, and the detailed description of the drawings given below, serve to explain the principles of the present invention.

DETAILED DESCRIPTION OF THE DRAWINGS

Figure 1:
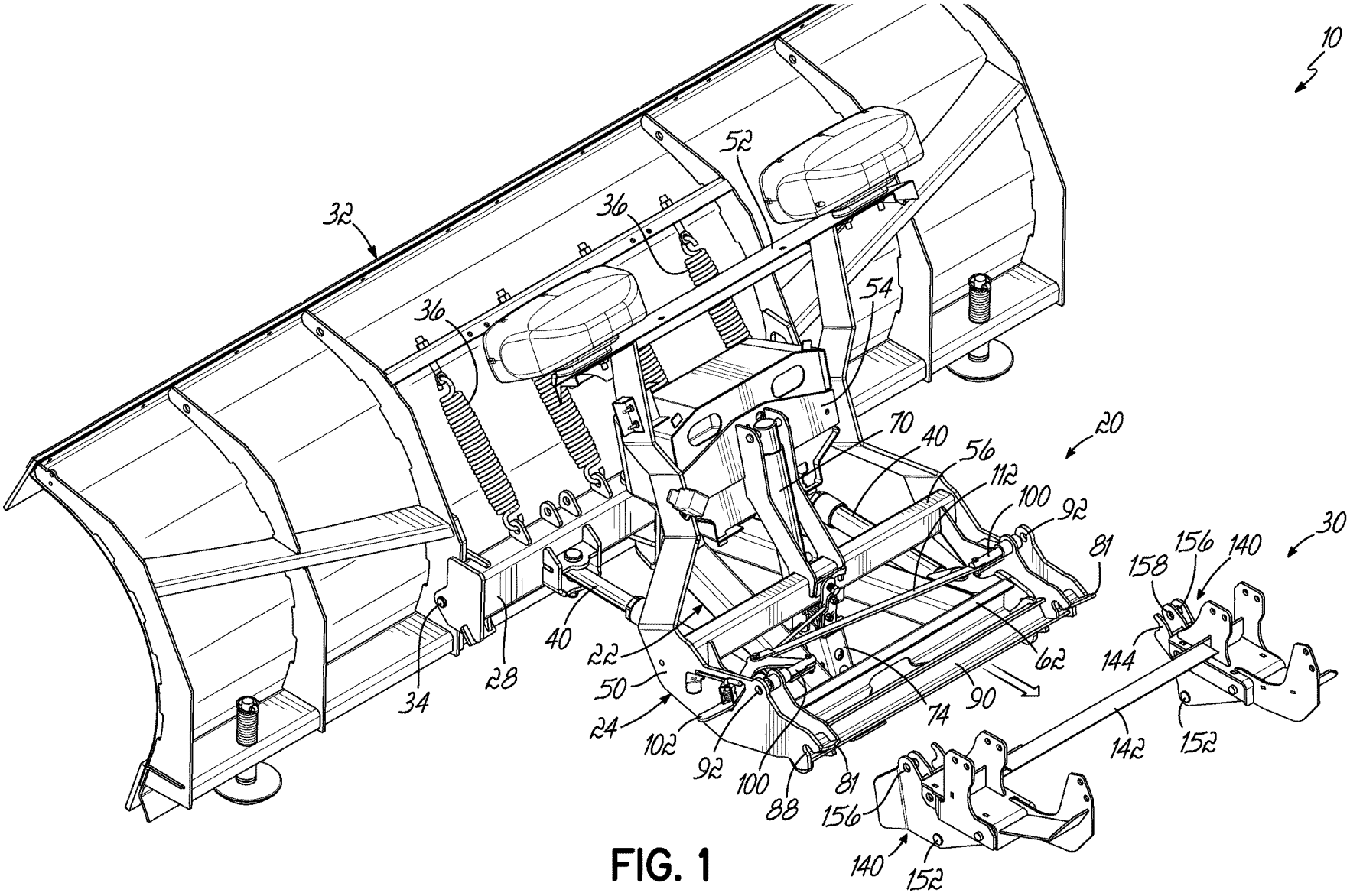
FIG. 1 is a left rear perspective view of the snow plow and mount assembly of the present invention.

Referring first to FIG. 1, a snow plow and mount assembly 10 of the present invention is illustrated. The assembly 10 comprises a snow plow frame 20 and a mount frame 30. Snow plow frame 20 comprises an A-frame 22 and a lift frame 24 pivoted to one another at 26 (FIGS. 4A-4D) for pivoting movement about a generally transverse horizontal lift axis. While the term "A-frame" has been used herein, it is to be understood that other configurations or shapes of frames other than "A's" may be substituted therefore in the practice of the present invention and yet still be within the scope thereof. Accordingly, the term "A-frame" shall be deemed to embrace all such configurations and shapes. A forward end of A-frame 22 is pivoted to a push beam 28 at 290 (FIGS. 2D, 2E, for example) for pivoting movement about a generally vertical axis. Plow blade 32 is pivoted to push beam 28 at 34 for pivoting movement about a generally transverse horizontal trip axis. Trip return springs 36 are mounted to the rear side of the blade 32 and to the push beam 28 to return the plow blade 32 to proper plowing orientation after tripping over an obstacle. Hydraulic cylinders 40 are mounted to the push beam 28 and to the A-frame 22 and are for angling the plow blade 32 about the generally vertical axis.

Referring to FIGS. 1-6C, lift frame 24 comprises a pair of upstanding frame members 50, and an upper transverse frame member 52, an intermediate transverse frame member 54, and a lower transverse frame member 56 interconnecting the frame members 50. A pair of vertical frame members 58 interconnects the intermediate and lower frame members 54, 56.

Figure 2A:
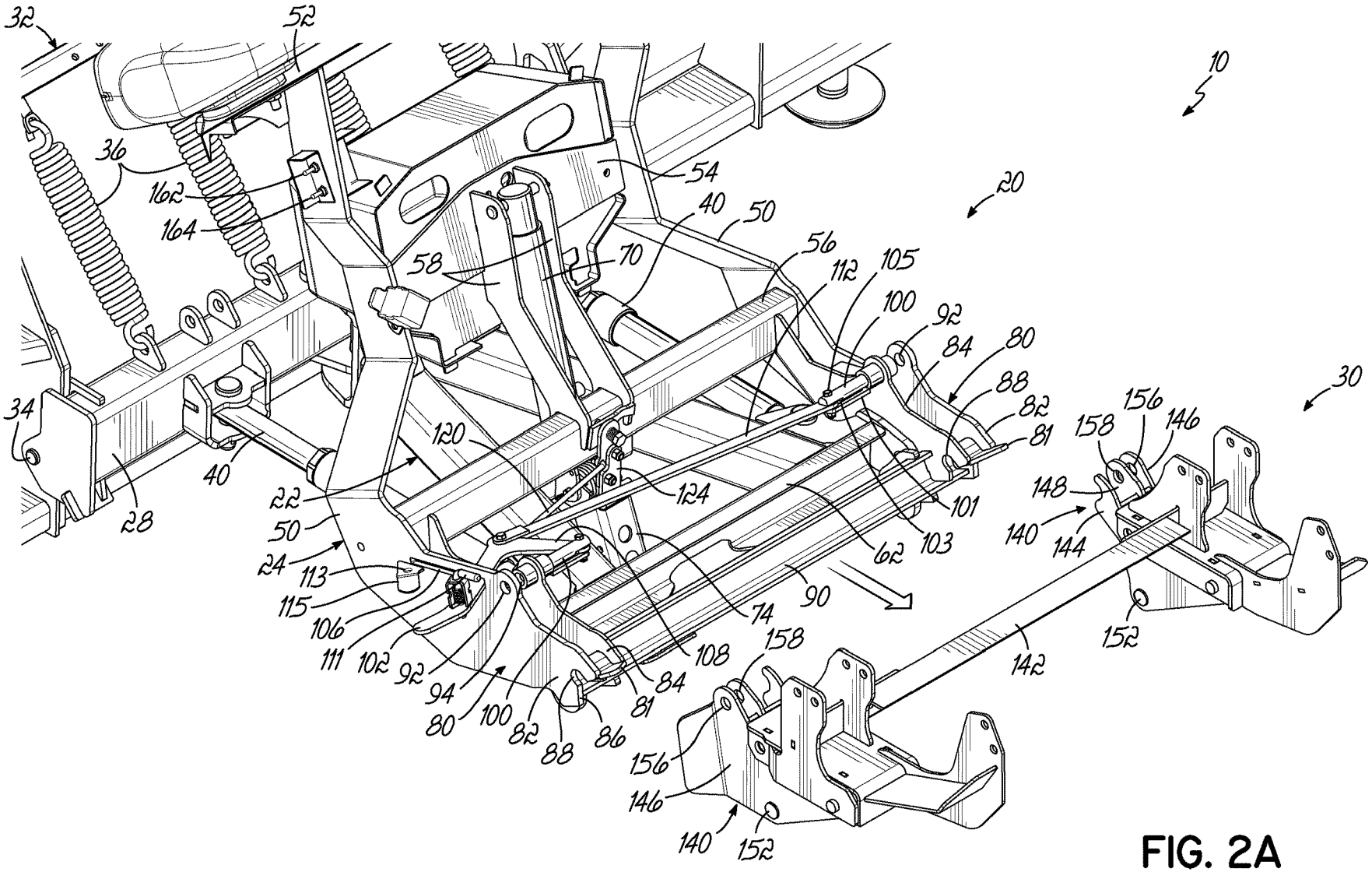
FIGS. 2A-2E are enlarged left rear perspective views of the assembly of FIG. 1 in various stages of hitching the snow plow frame to the mount frame.
Figure 2B:
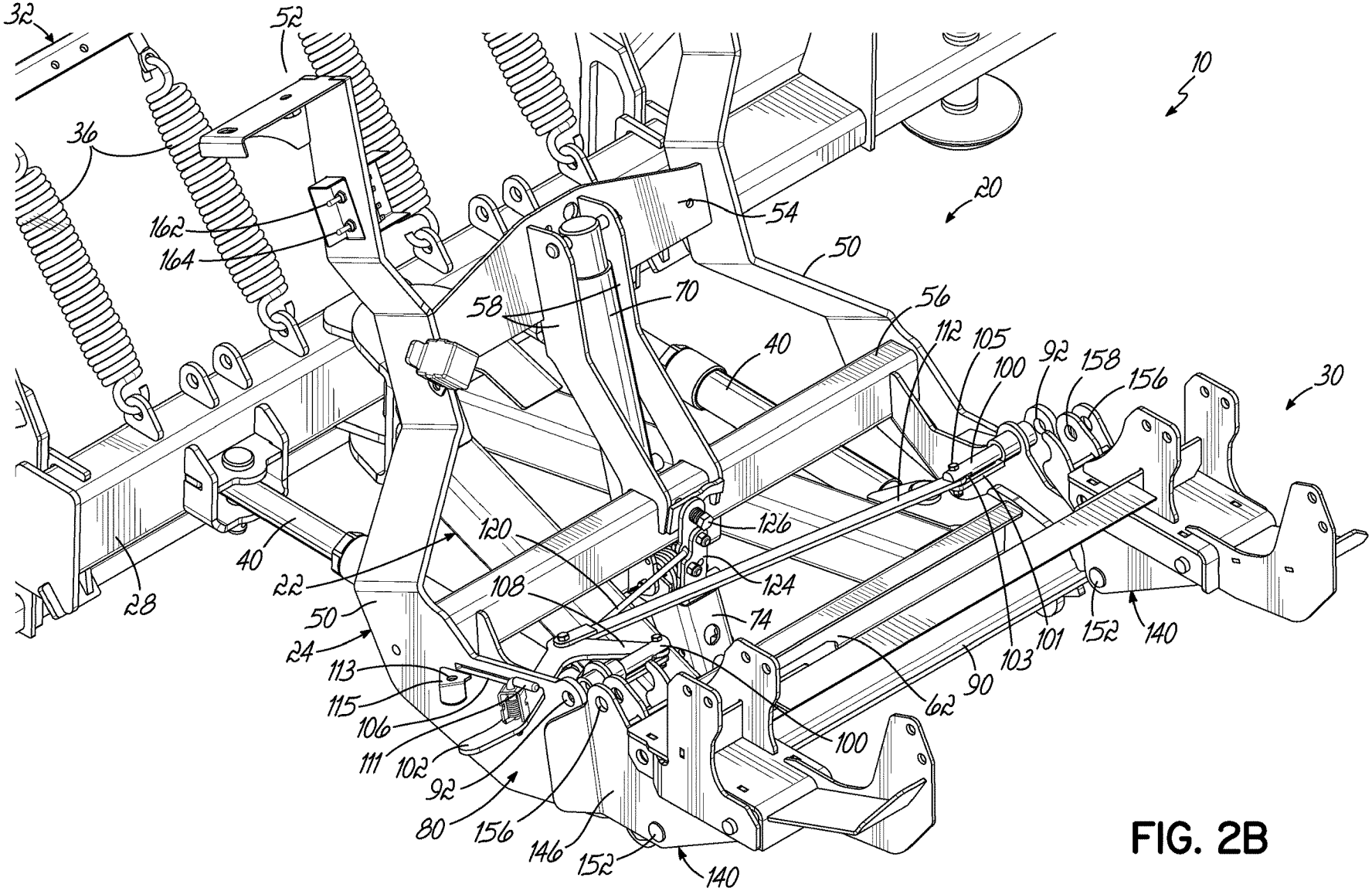
Figure 2C:
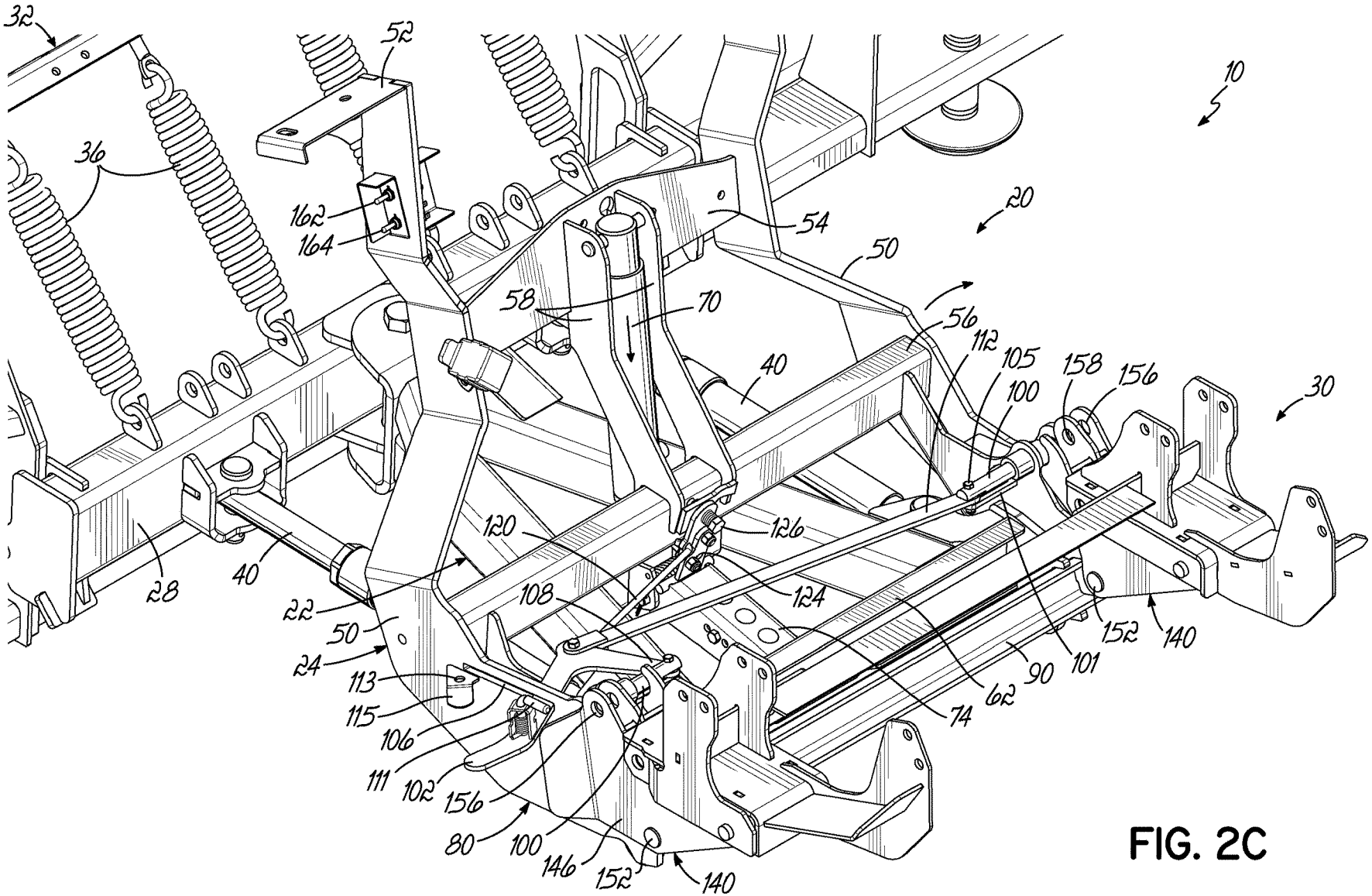
Figure 2D:
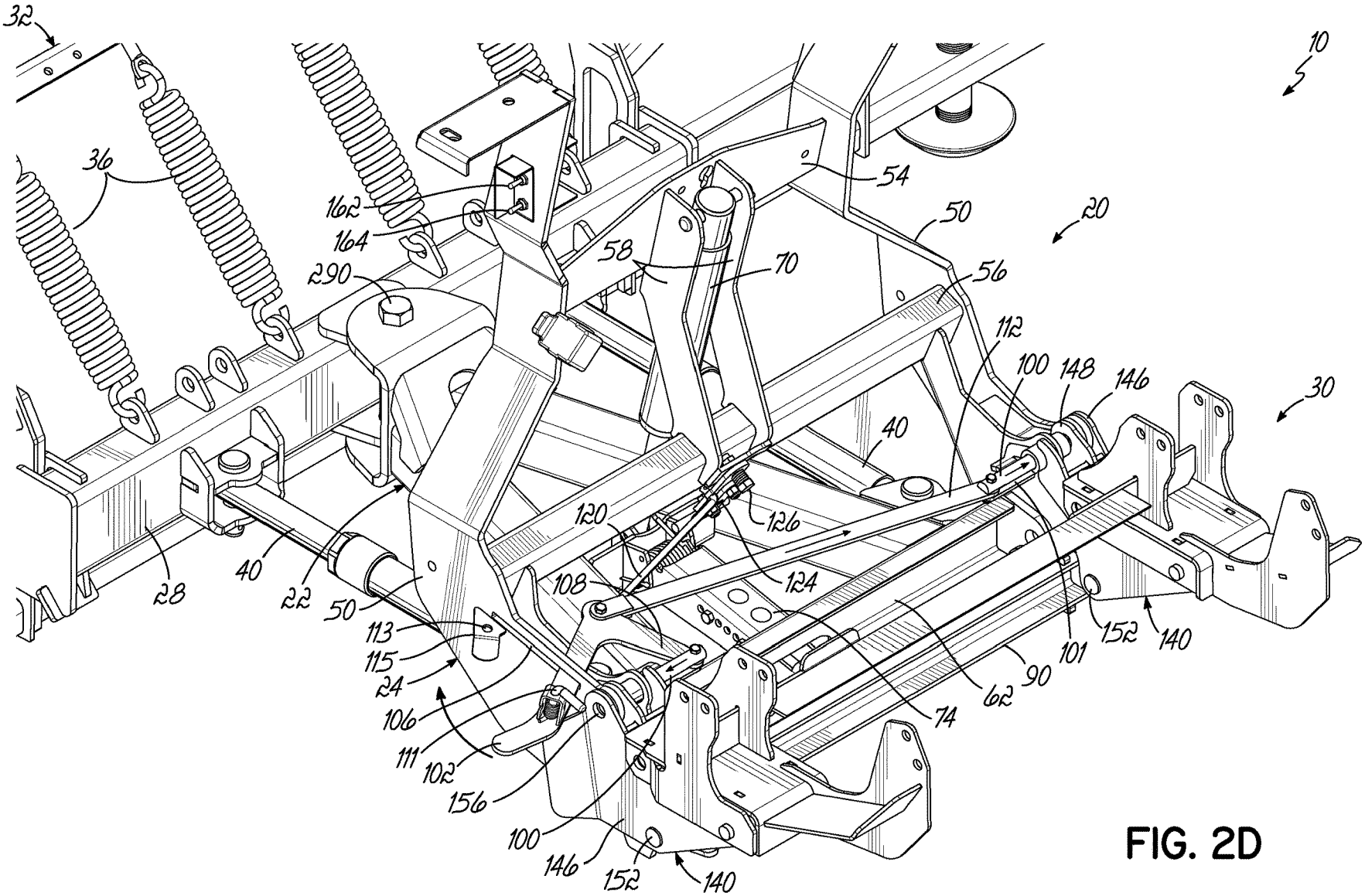
Figure 2E:
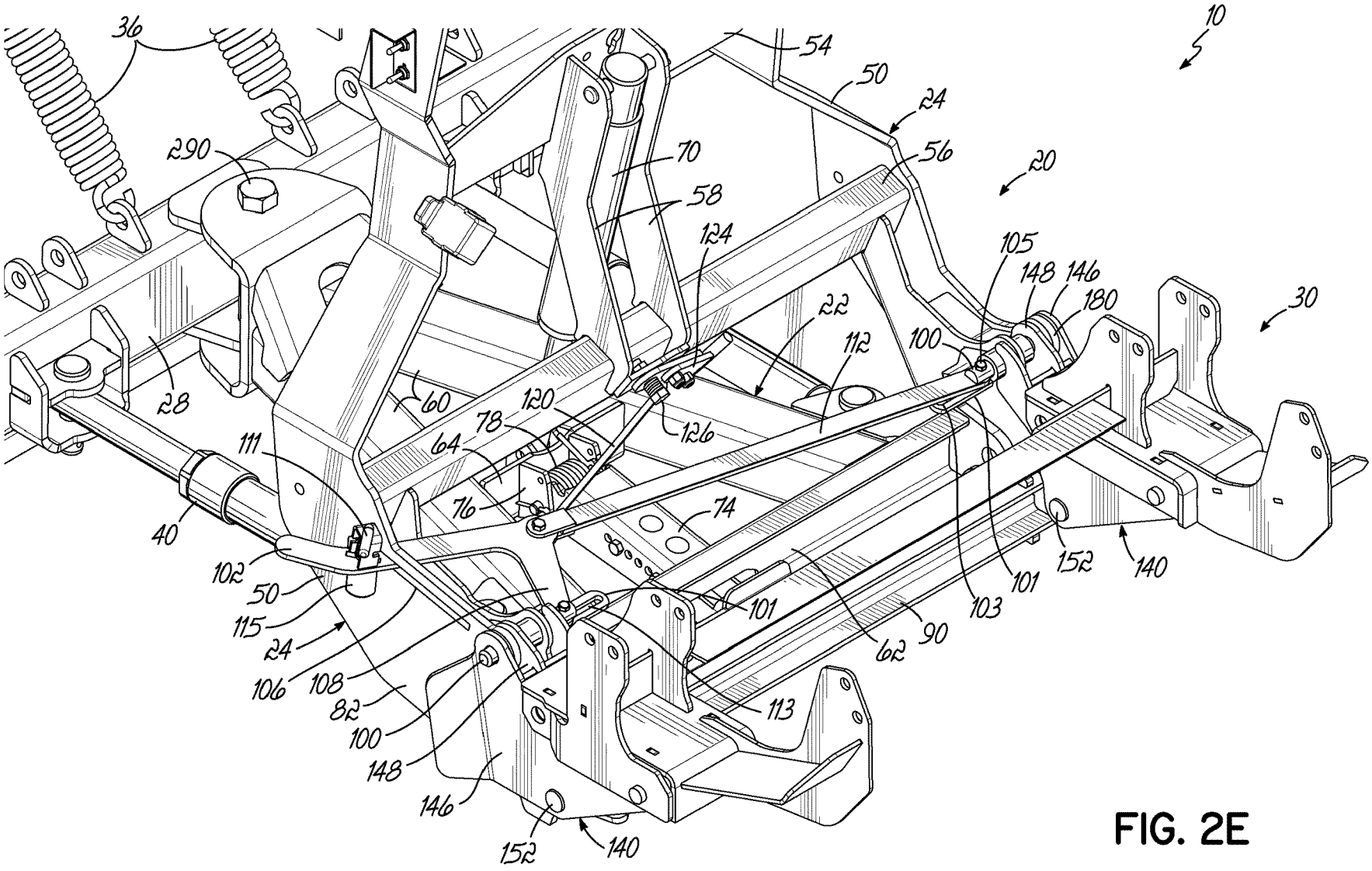

Referring to FIG. 2E for example, A-frame 22 comprises a pair of side frame members 60 connected together at their forward ends via a clevis 288 (FIG. 7) and a transverse member 62 interconnecting the side frame members 60 at their rearward ends. A plate or angle section 64 interconnects the side frame members 60 between their forward and rearward ends.

Referring to FIG. 2E for example, a hydraulic cylinder 70 has one end mounted to a side, for example the forward side, of the plate 64 of the A-frame 22 and the other end mounted between the vertical frame members 58 of the lift frame 24. A support stand 74 is movably mounted to the A-frame 22, for example for pivoting movement or translational movement or both. As one example, the stand 74 can be pivotally mounted to a side, for example the rearward side, of the plate 64 at 76. Stand 74 pivots to an extended ground or pavement contacting and snow plow frame 20 supporting position and to a retracted position at which the stand 74 does not contact the ground or pavement and does not support the plow frame 20. The stand 74 is biased, for example spring biased, to the retracted position by a torsion spring 78. As used herein, the terms "ground" and "pavement" shall be deemed to be interchangeable and shall be deemed to embrace such surfaces whether the surfaces are snow and/or ice covered or bare.

Figure 3:
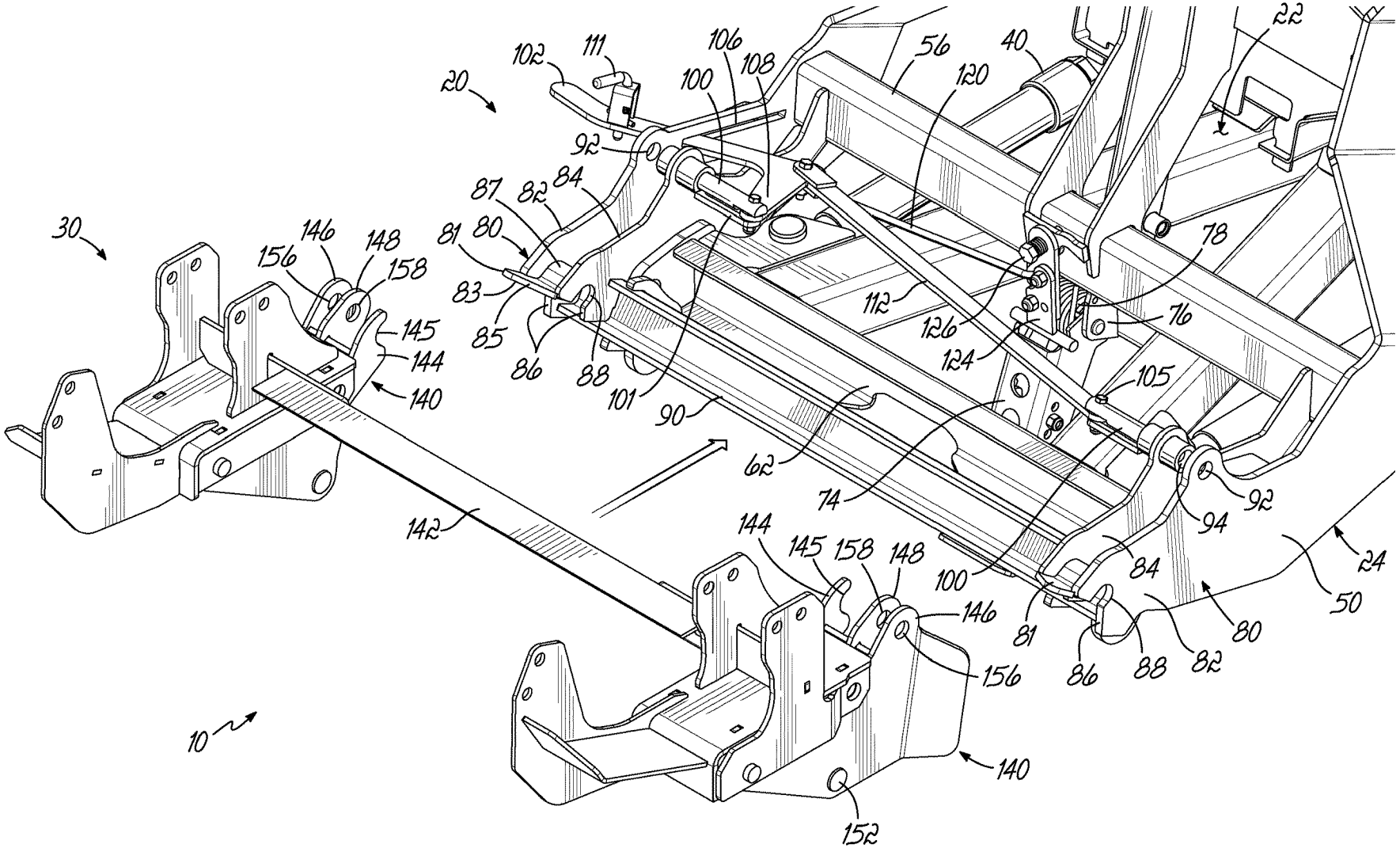
FIG. 3 is an enlarged right rear perspective view similar to FIG. 2A.
Figure 4:
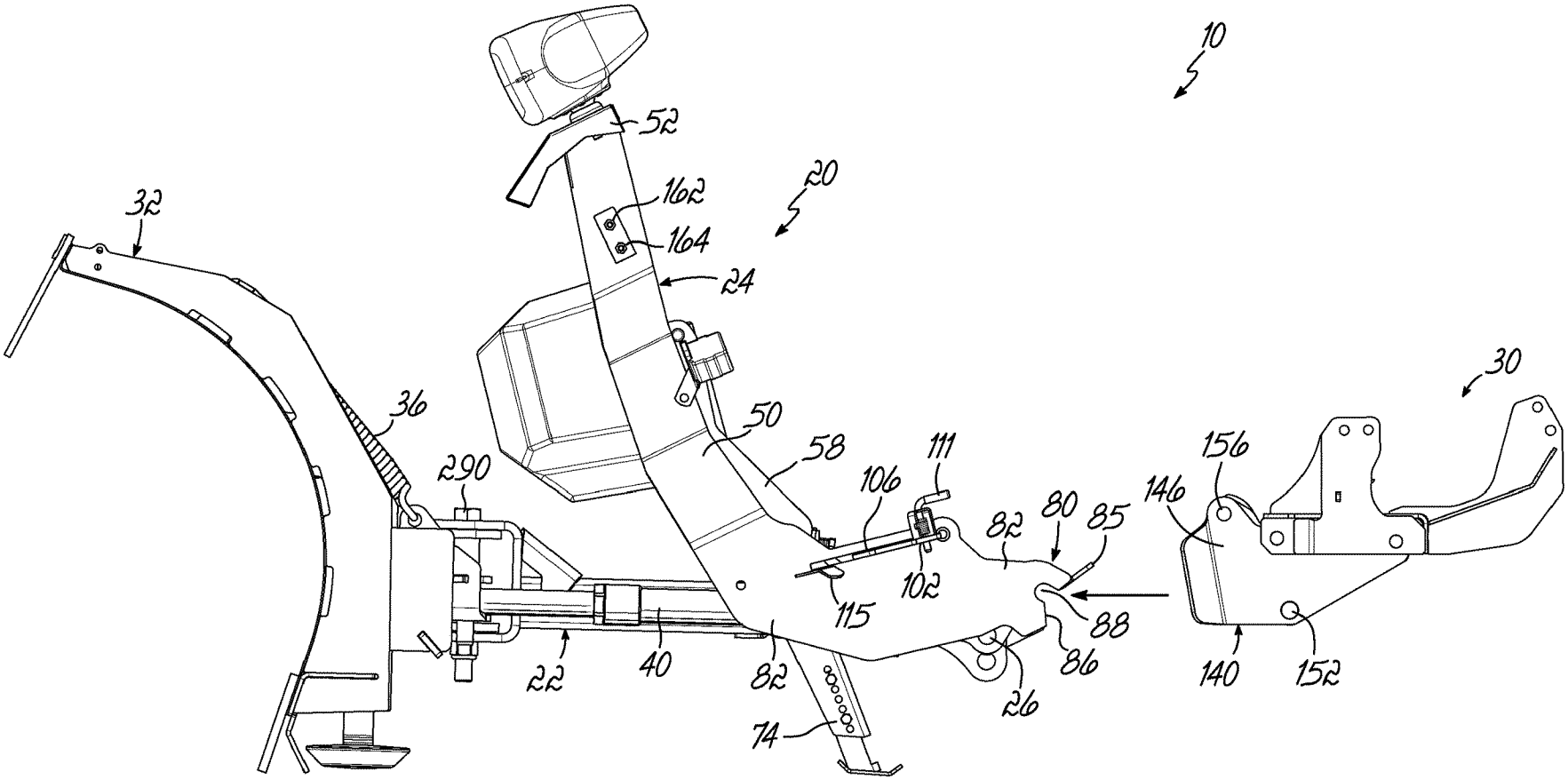
FIG. 4 is a side view of the assembly of FIG. 1.
Figure 4A:
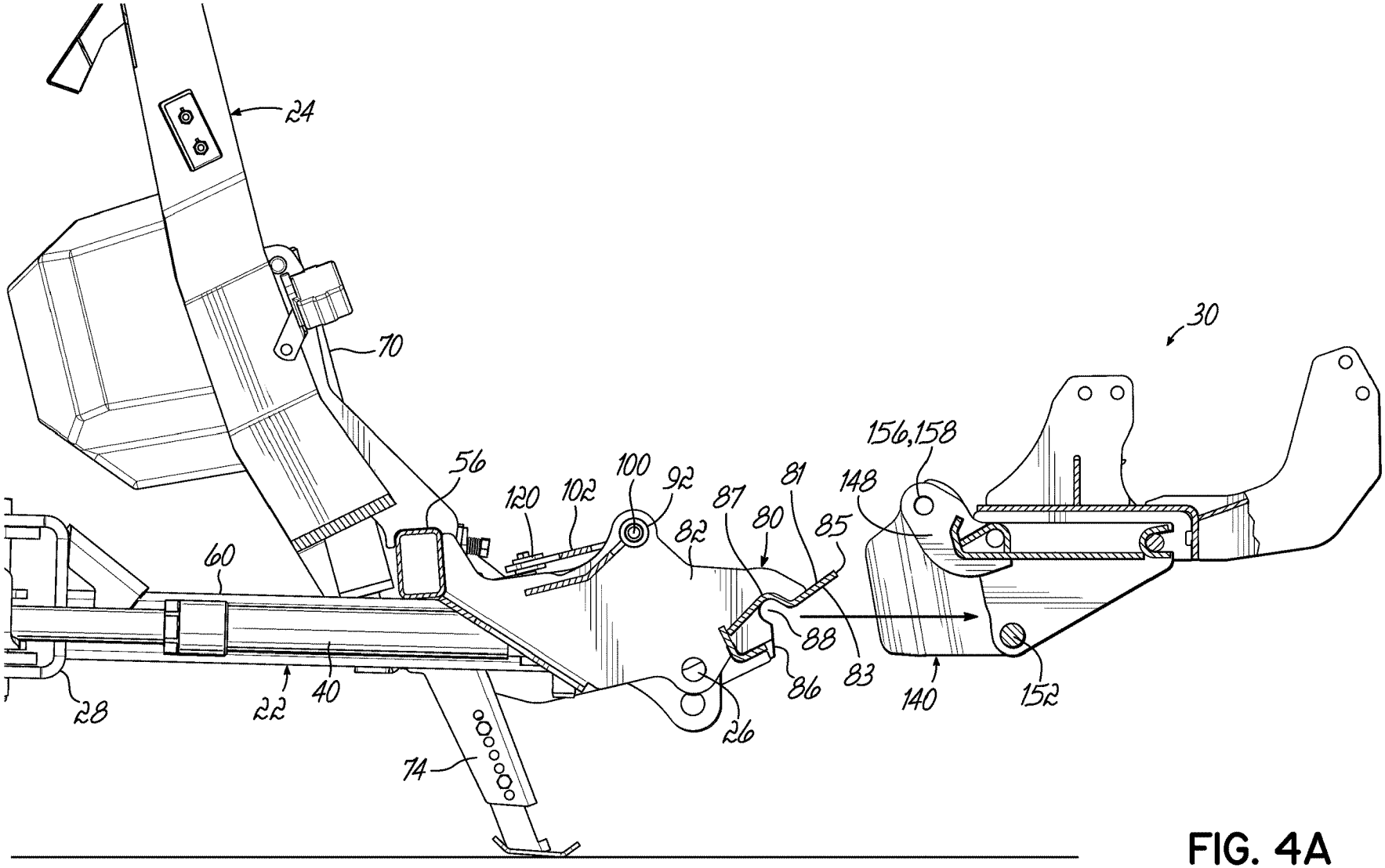
FIGS. 4A-4D are side views of the assembly of FIG. 1 in various stages of hitching the snow plow frame to the mount frame.
Figure 4B:
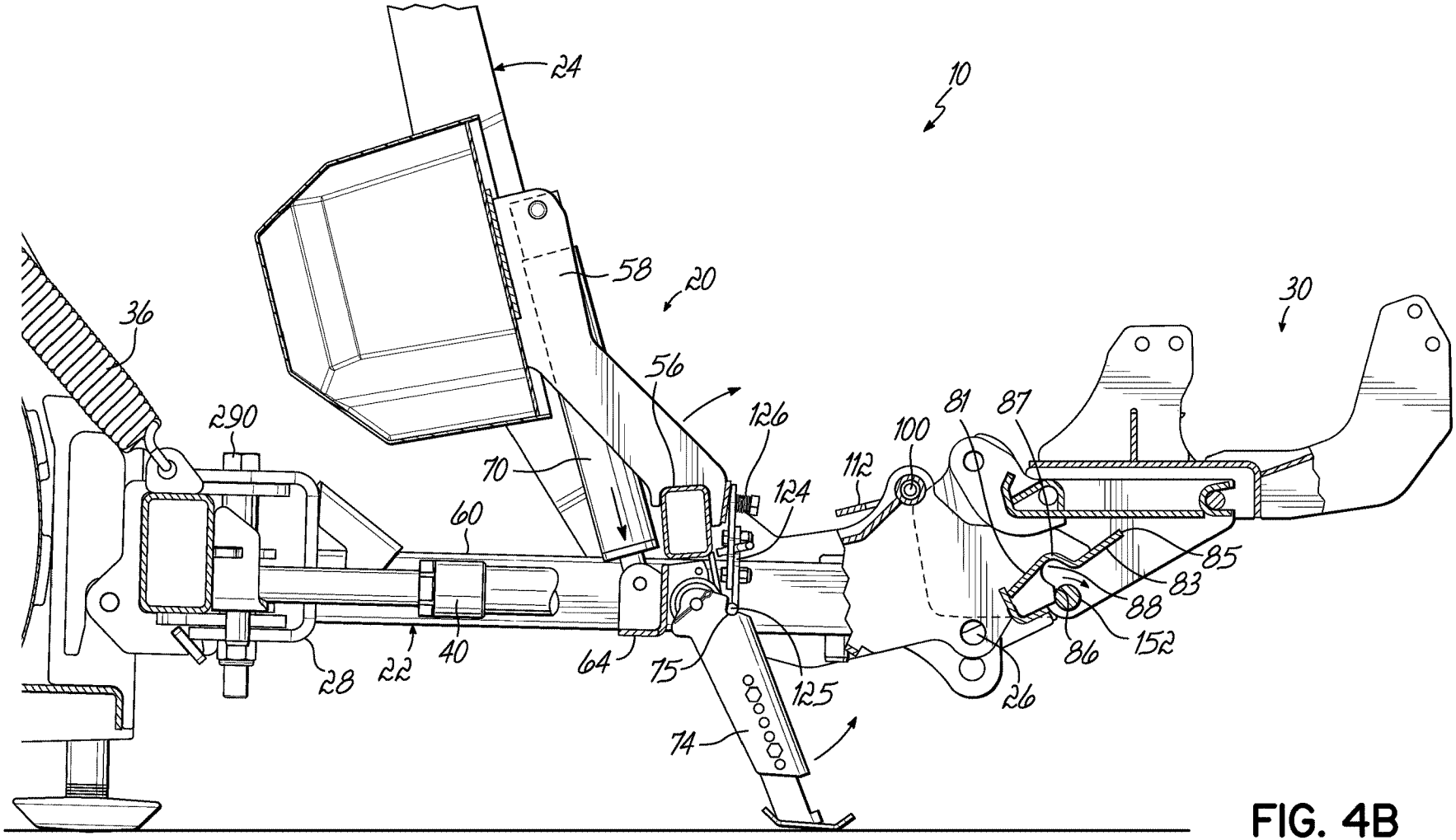
Figure 4C:
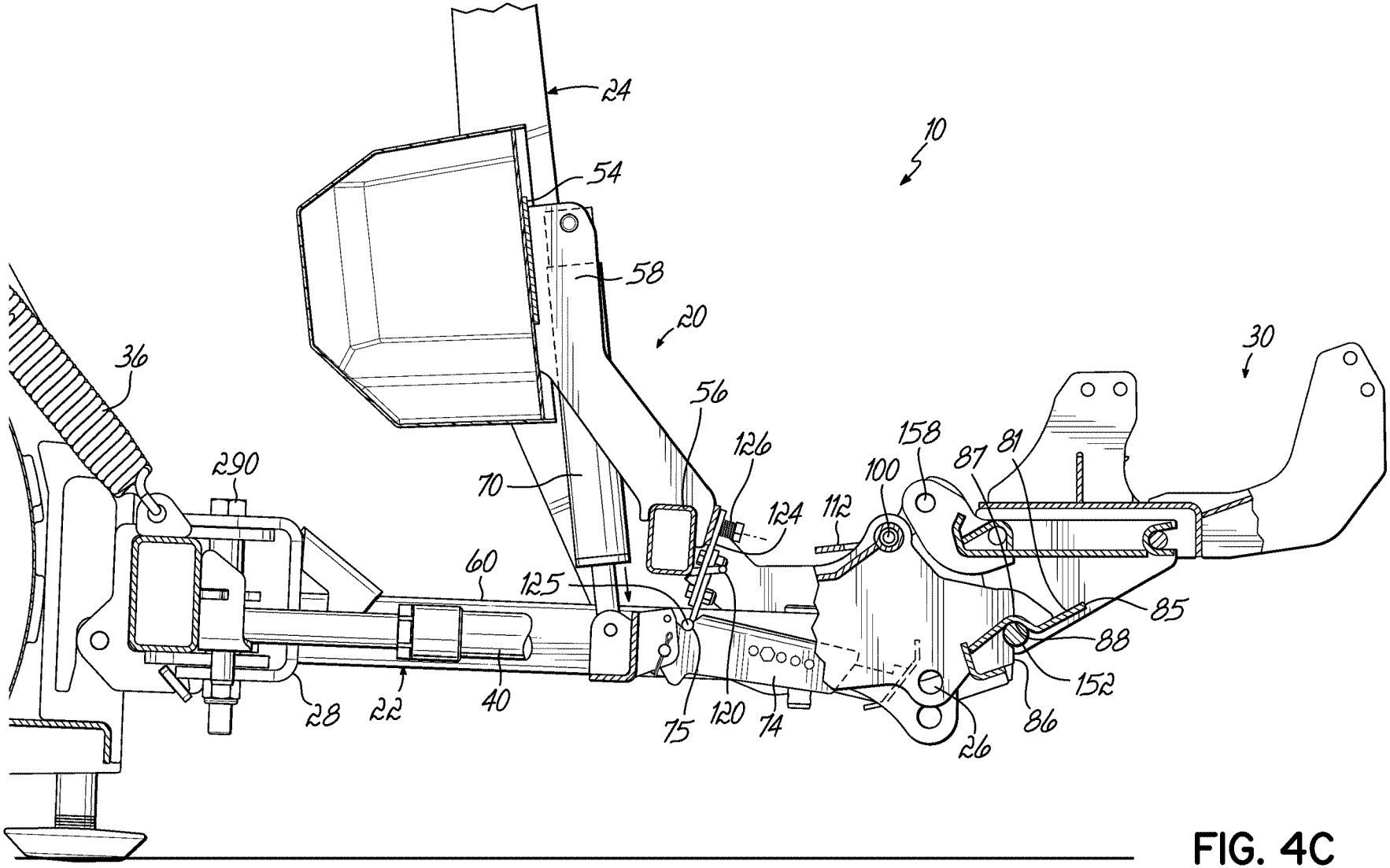
Figure 4D:
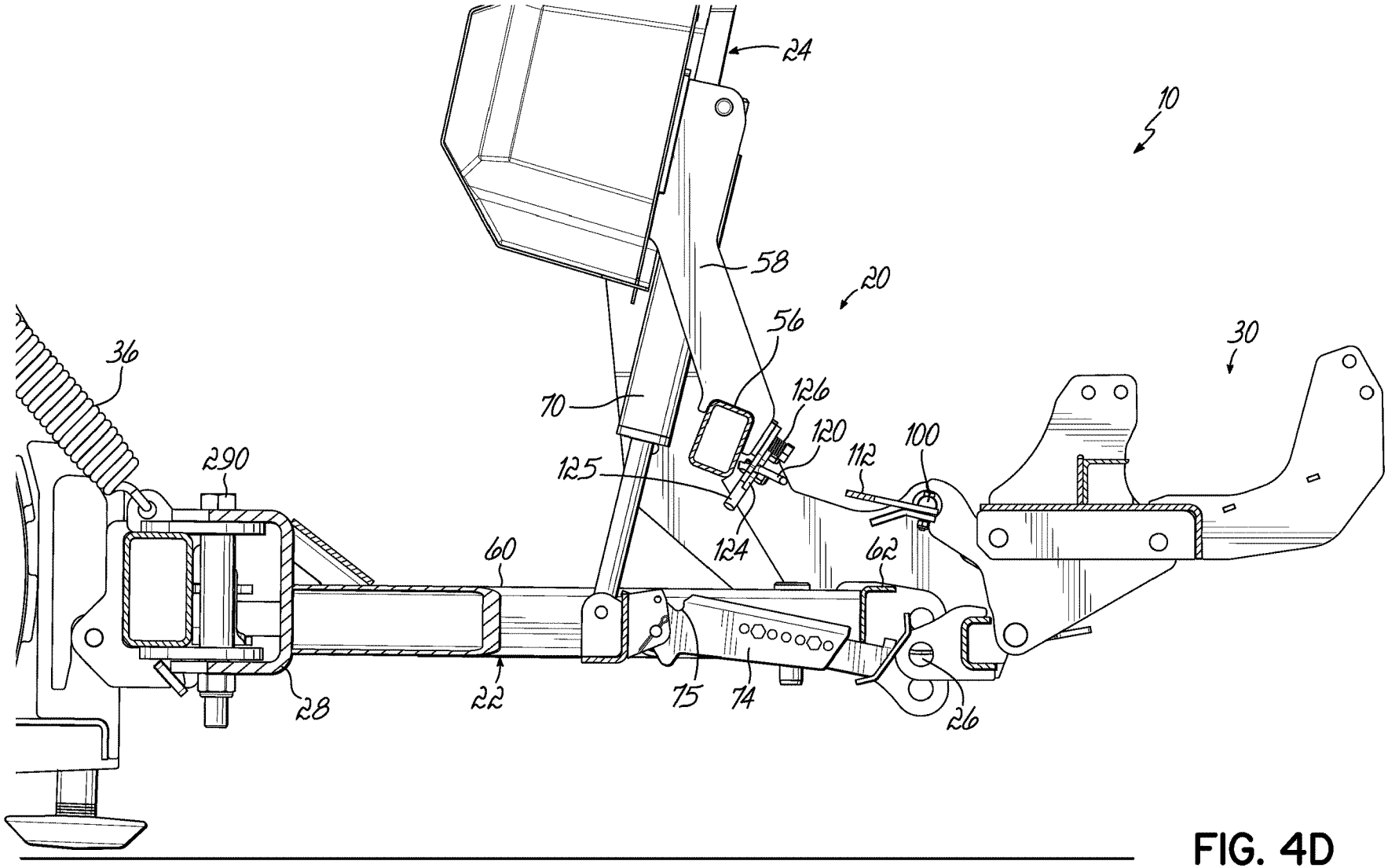

Referring to FIGS. 2A, 3, and 4A for example, the lower end of each upstanding frame member 50 of the lift frame 24 has a rearwardly extending arm 80. Each arm 80 can be, but is not necessarily required to be, comprised of a pair of spaced apart plates 82, 84. The end of each arm 80, and as illustrated the end of each plate 82, 84, has a flat 86 formed thereon and a forwardly extending recess 88 formed therein above the flat 86. The inner plates 84 of the arms 80 are interconnected with a transverse frame member 90. The plates 82, 84 making up each arm 80 have holes 92, 94, respectively. The holes 92, 94 have a latch pin 100 that travels in them from an inward unlatched position to an outward latched position. A latch lever 102 is movable in a slot 106 in one of the plates 82. An end 108 of the lever 102 is pivotally connected to one of the latch pins 100, and a link 112 is pivotally connected on one end to the latch lever 102 intermediate its ends and on the other end to the other latch pin 100. A connecting rod 120 is pivotally connected on one end also to the lever 102, and on the other end to a toggle link 124 which itself is pivotally connected at 126 to intermediate frame member 56 of lift frame 24. Referring to FIGS. 3 and 5A-5E for example, stand 74 includes a transverse notch 75 formed therein for receiving a transverse rod 125 at the lower end of toggle link 124. As seen in FIG. 2E for example, each latch pin 100 has a guide bracket 101 associated therewith cantilevered off of its respective plate 84. Each guide bracket 101 includes a transversely oriented guide slot 103 therein. Each guide slot 103 guides the lower end of a connecting pin 105 connecting one of the latch pins 100 to the end of lever 108 and the other of the latch pins 100 to the end of link 112, respectively, to guide and assist the latch pins 100 in moving through the various latch holes.

Referring to FIGS. 1-6C for example, mount frame 30 is adapted to be mounted to the frame of a pickup truck generally below and generally behind the front bumper, and has a pair of spaced apart receivers 140 interconnected by transverse frame member 142. Each receiver 140 has an inner plate 144, an outer plate 146, and an intermediate plate 148. Each receiver 140 has a hitch pin 152 positioned in a lower region and interconnecting the three plates 144, 146, 148 making up the receiver 140. The outer plates 146 have a latch hole 156 therein, and the intermediate plates 148 have a latch hole 158 therein. Each inner plate 144 has a recess 145 therein which partially encircles its respective latch pin 100 when latched.

Note that while the lift frame 24 has been described as having the arms 80 and the mount frame 30 has been described as having the receivers 140, it is within the scope of the invention that the lift frame 24 has the receivers 140 and the mount frame 30 has the arms 80. Note also that while the lift frame 24 has been described as having a pair of arms 80 and the mount frame 30 has been described as having a pair of receivers 140, it is within the scope of the invention that the snow plow and mount assembly has a single arm and a single receiver. For example, the single arm could be a plate spanning the width of the lift frame 24 and the receiver could be a box section or a pair of facing C-sections, etc. spanning the width of the mount frame 30, and sized for receiving the plate. As well, the single arm could be on either the lift frame 24 or the mount frame 30, and the receiver could be on the other of lift frame 24 and the mount frame 30.

Referring to FIGS. 2A-2D and 4 for example, one of the upstanding frame members 50 of the lift frame has two switches, 162, 164. One of the switches 162 disables the cab controls of the snow plow assembly, and the other of the switches 164 operates a suitable electric motor, hydraulic pump, and the like to extend and retract the hydraulic cylinder 70.

Figure 5A:
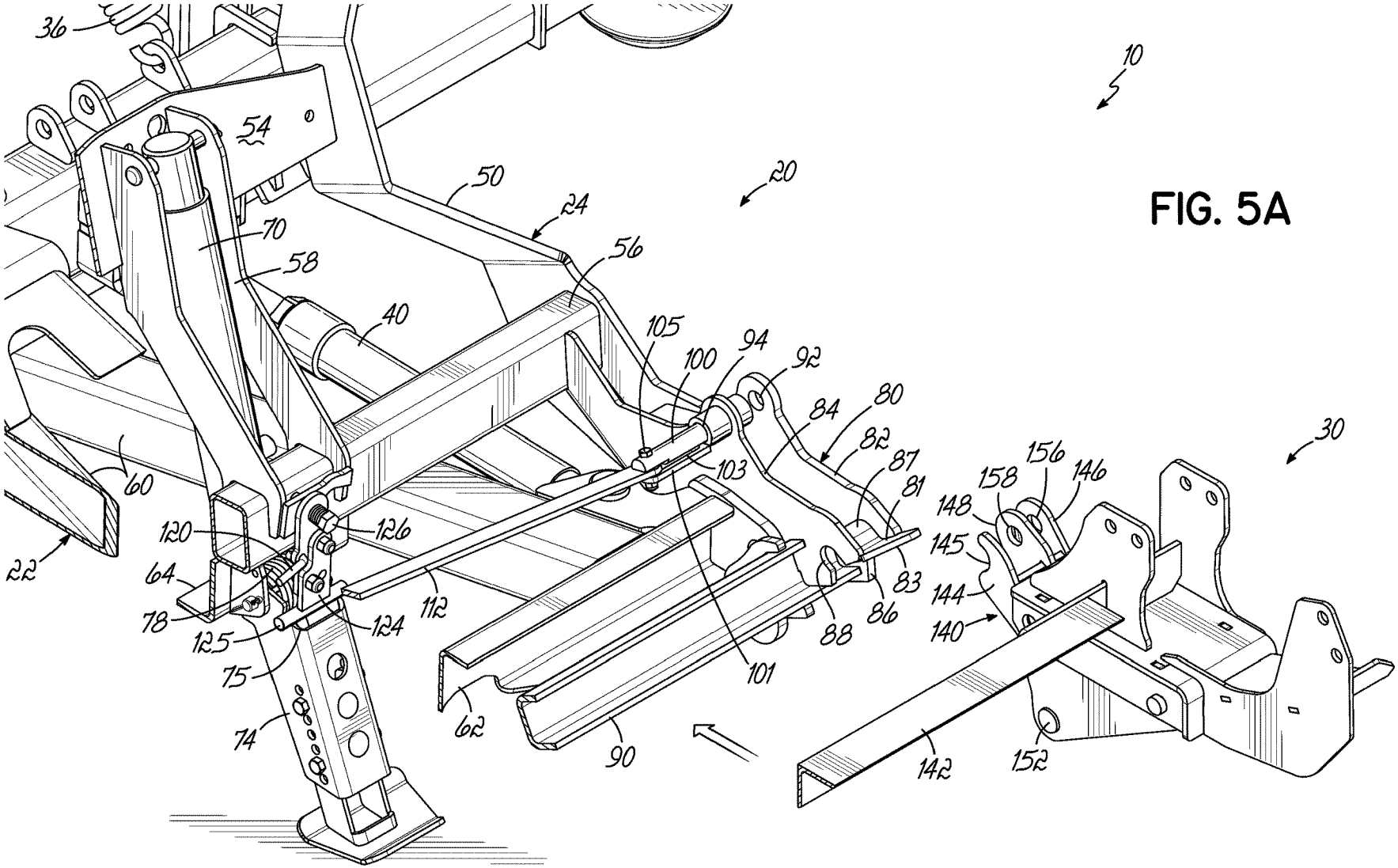
FIGS. 5A-5E are enlarged left rear perspective views of the assembly of FIG. 1, partially broken away, in various stages of hitching the snow plow frame to the mount frame.
Figure 5B:
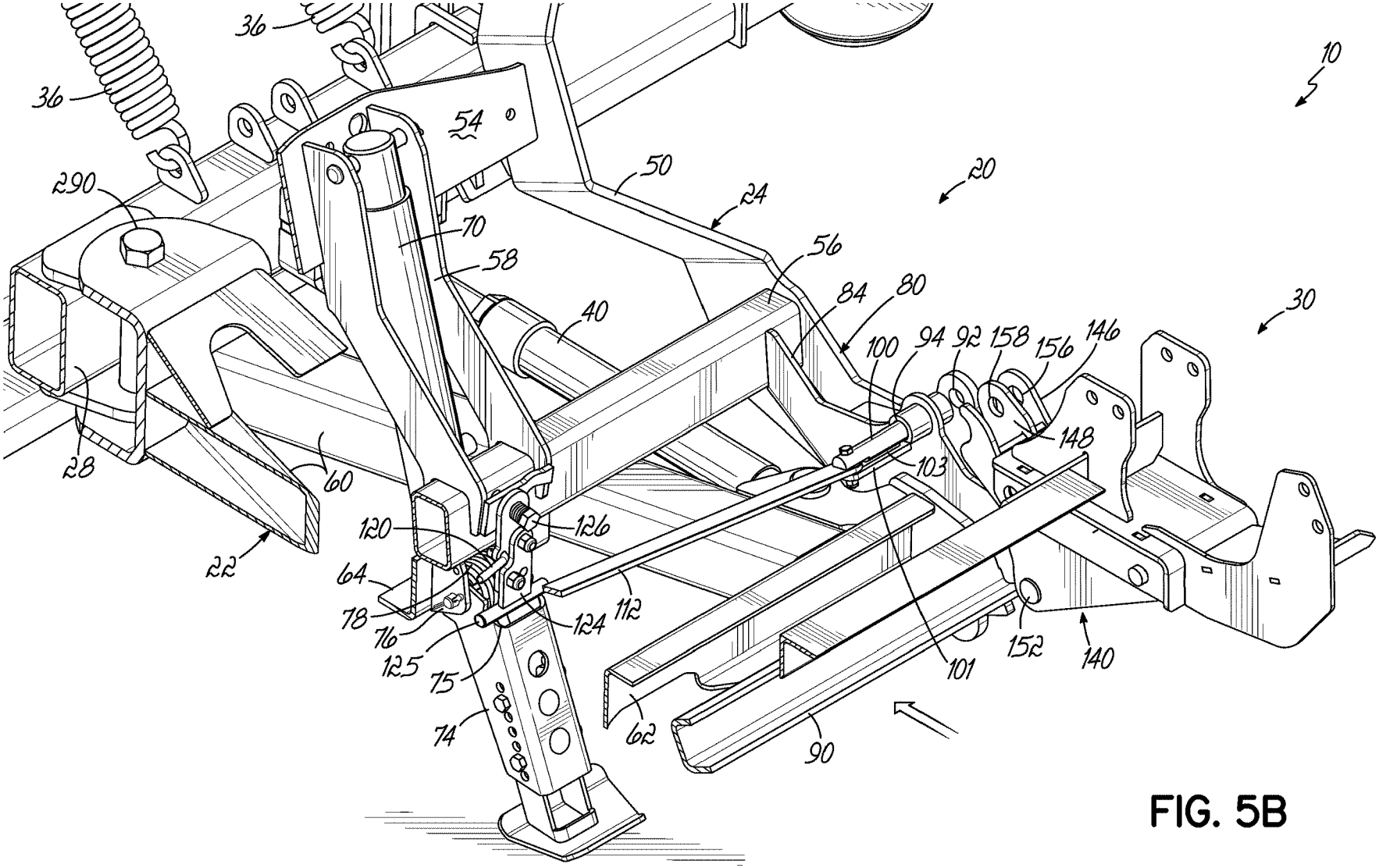
Figure 5C:
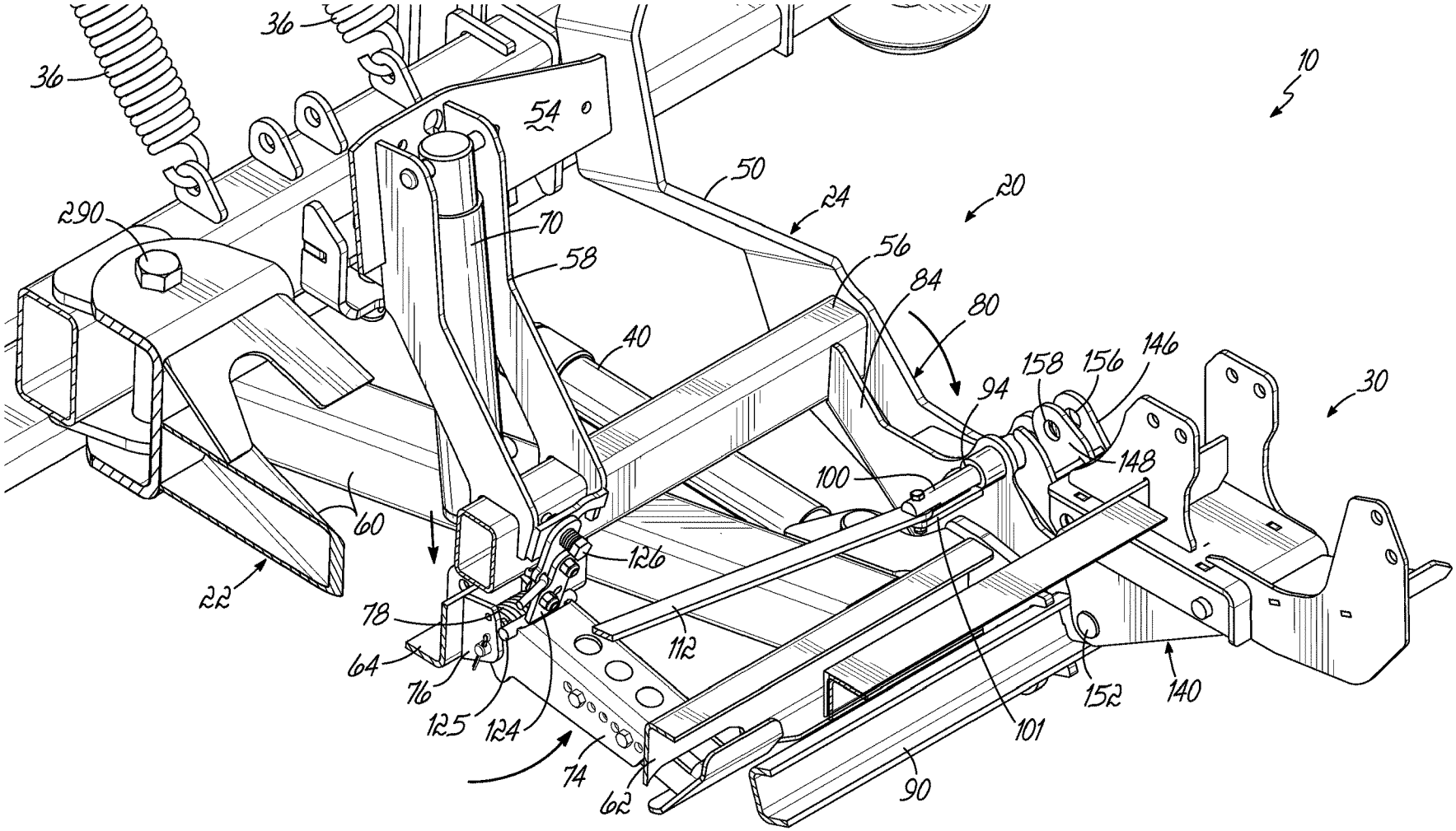
Figure 5D:
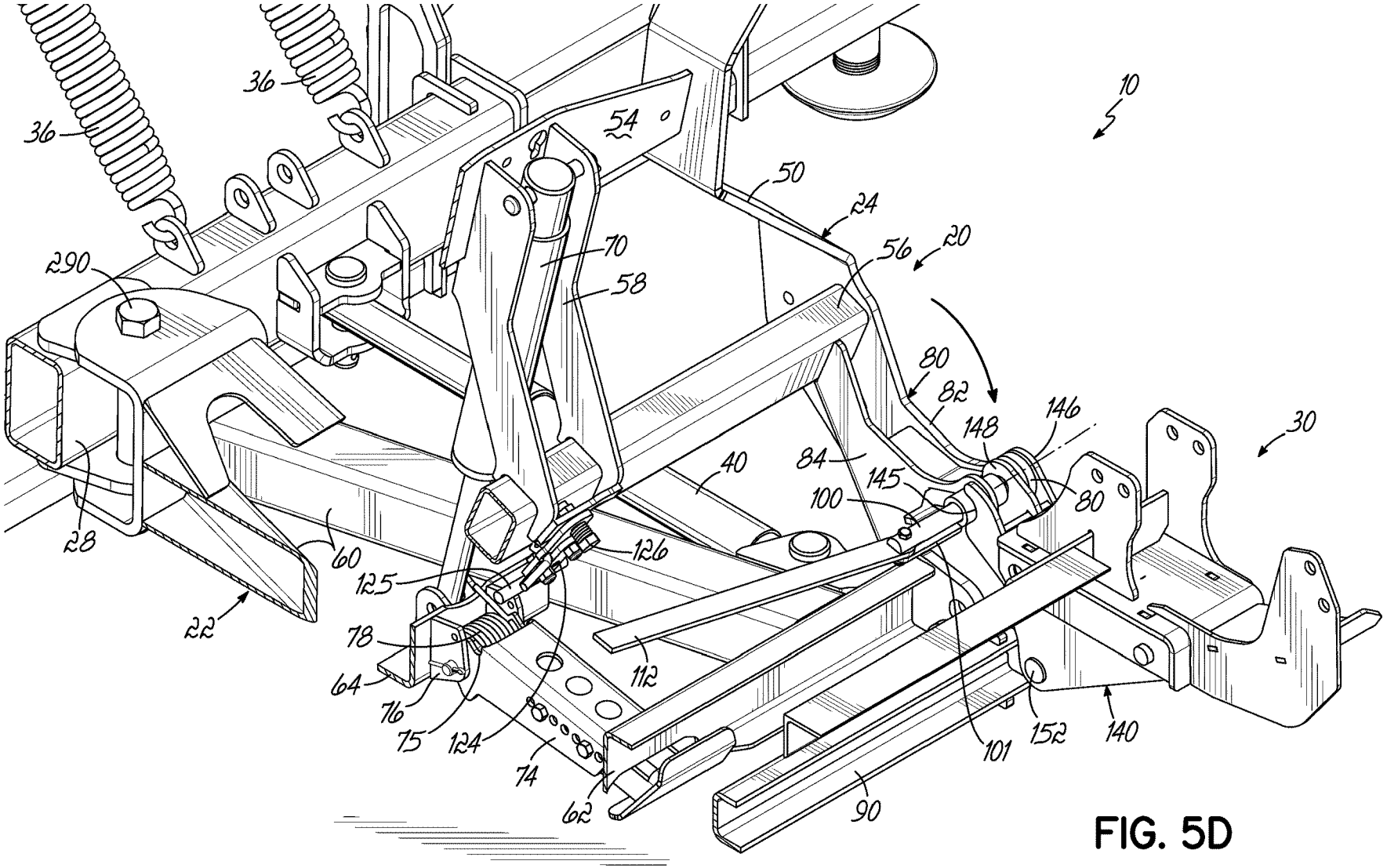
Figure 5E:
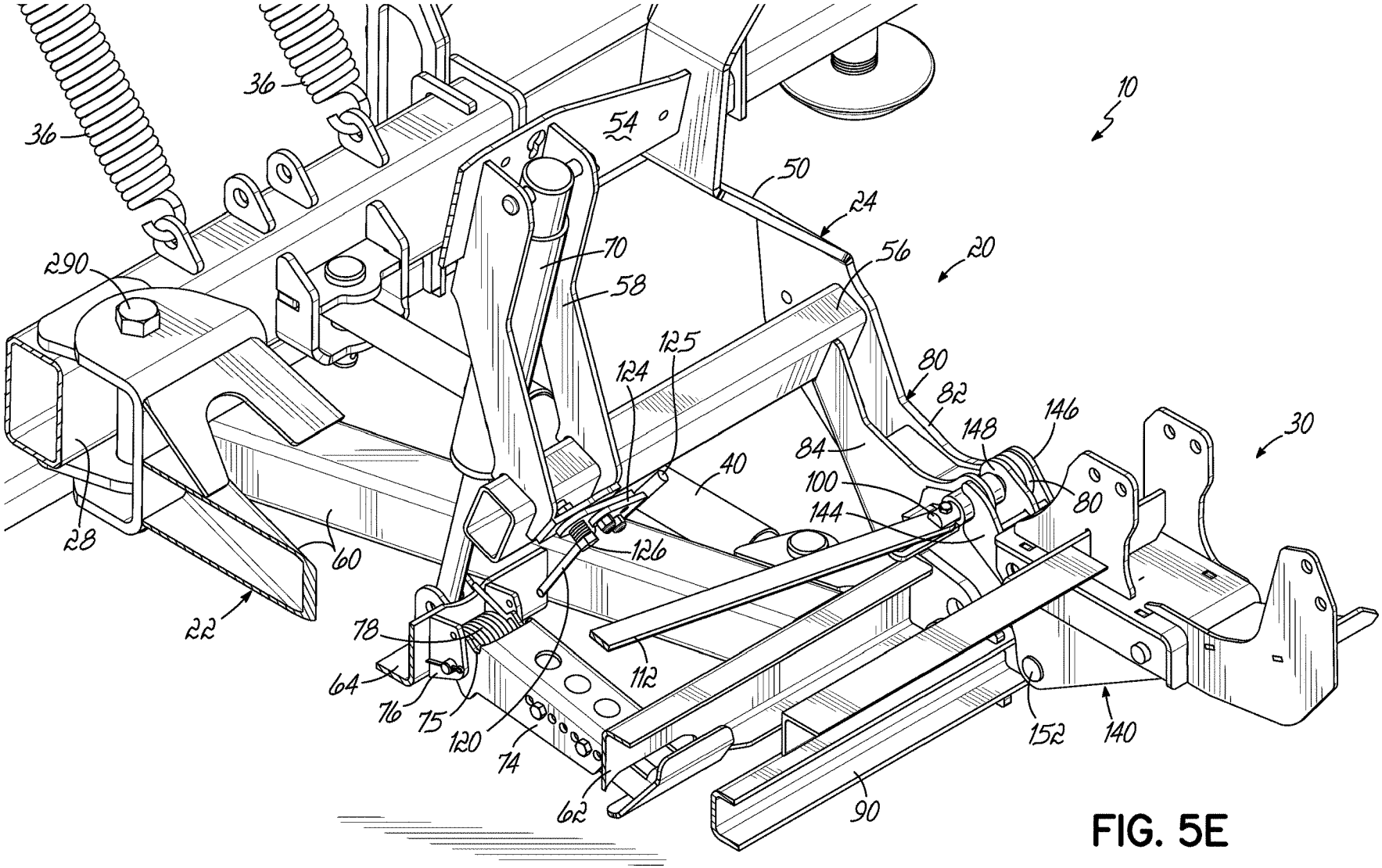
Figure 6A:
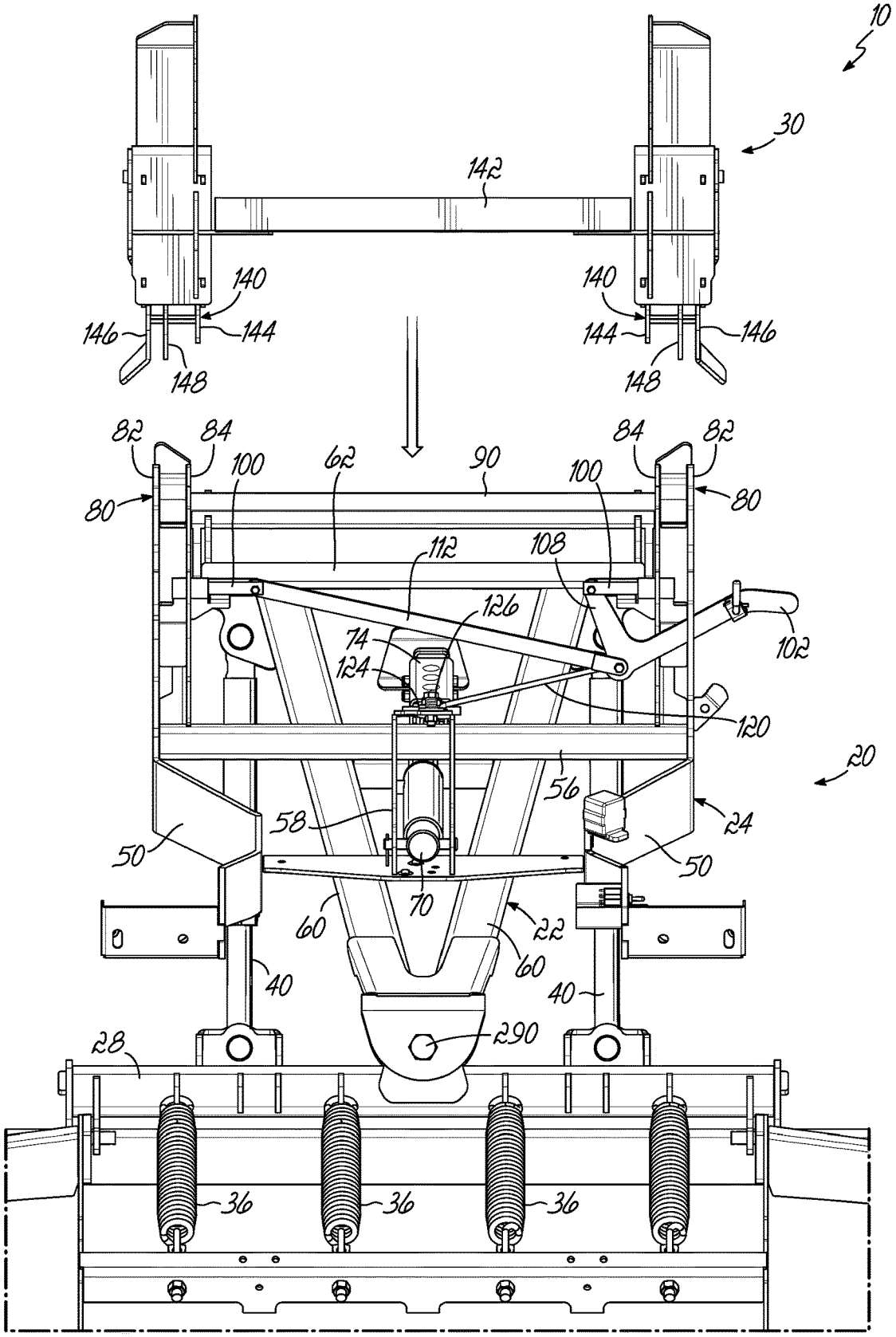
FIGS. 6A-6C are top views of the assembly of FIG. 1 in the various stages of hitching the snow plow frame to the mount frame.
Figure 6B:
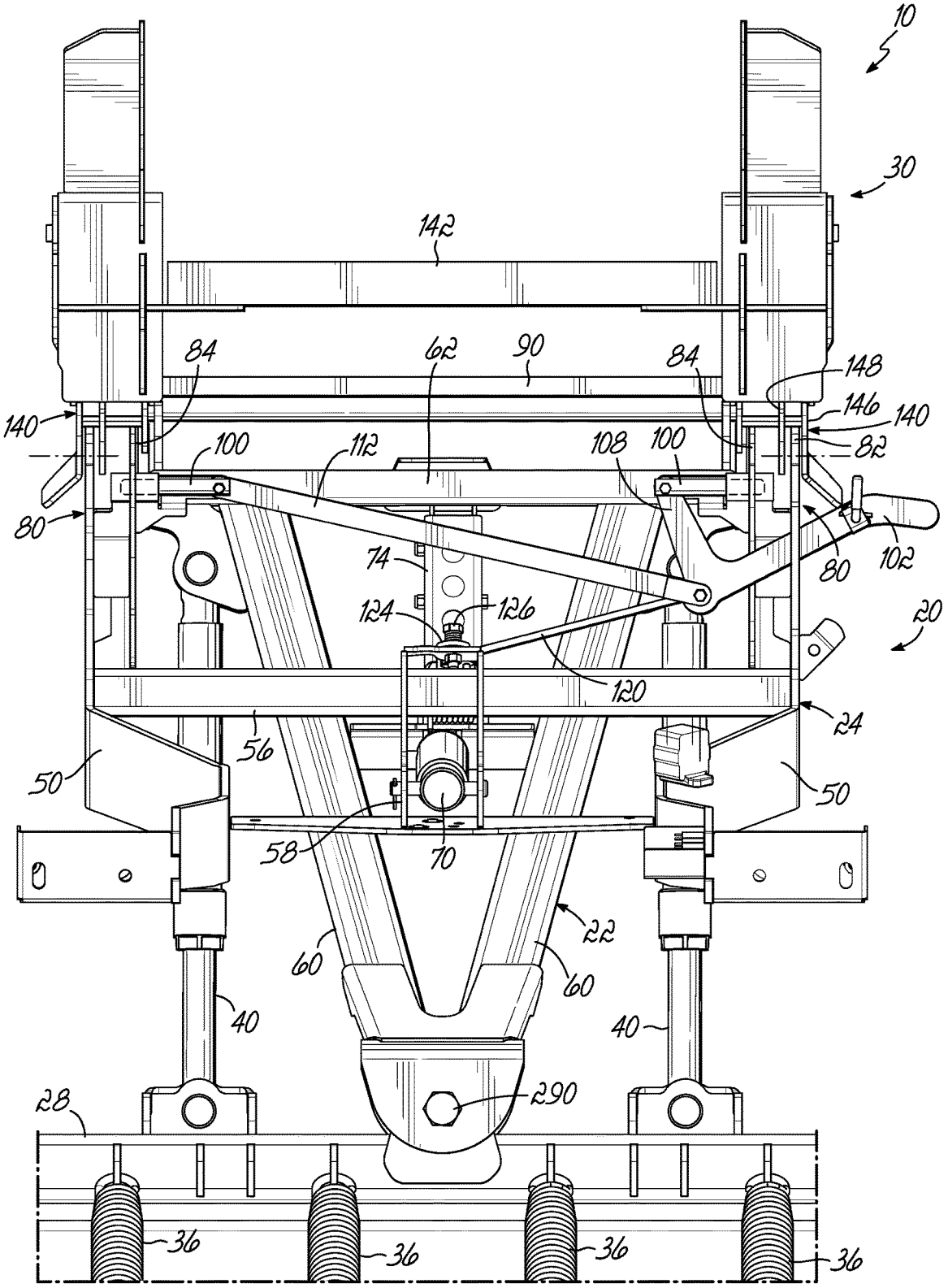
Figure 6C:
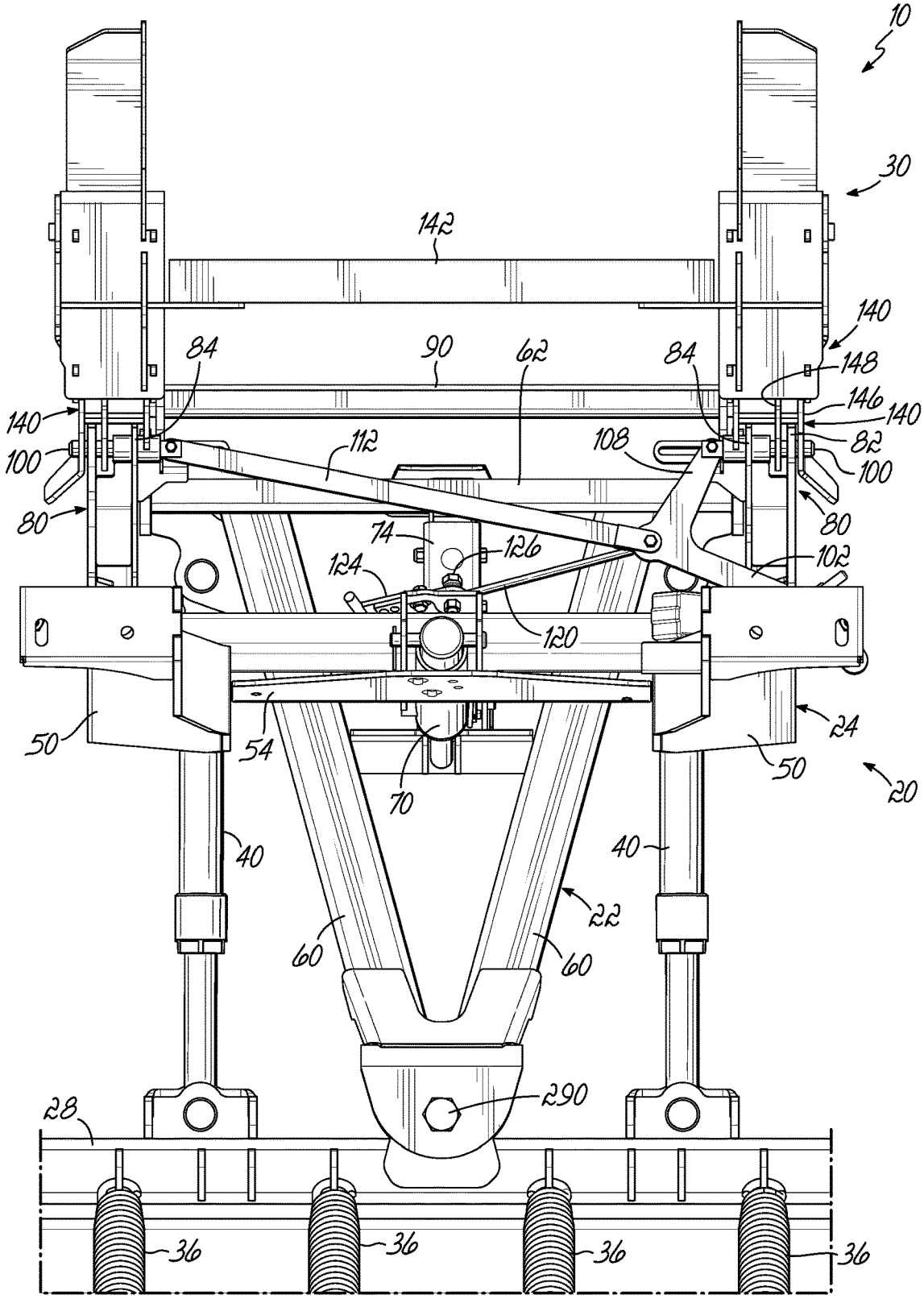

Referring now to FIGS. 2A-2E, 4A-4D, 5A-5E, and 6A-6C, hitching of the mount frame 30 to the snow plow frame 20 will be explained. With the plow frame 20 supported by stand 74 and with the mount frame 30 mounted on the truck, an operator drives the truck towards the plow frame 20 such that arms 80 are received in receivers 140, and further until such time as the hitch pins 152 in receivers 140 strike the flats 86 on the arms 80 (FIGS. 2A, 2B, 4A, 4B, 5A, 5B, 6A, and 6B). The operator disembarks from the truck and walks to a position alongside the plow frame 20 and connects the truck electrical system to the plow electrical system. The operator switches switch 162 to disable the in-cab plow controls, and switches switch 164 to extend the hydraulic cylinder 70 pivoting the lift frame 24 clockwise (as viewed in FIG. 4B) until the hitch pins 152 in the receivers 140 are received in the recesses 88 in the arms 80, and further until the holes 92, 94 in the plates 82, 84 of the arms 80 are aligned with the holes 156, 158 in the plates 146, 148 of the receivers 140 (FIGS. 2C, 4C, 4D, and 5C). Initially, the toggle link 124 is in its deployed position, and in contact with the stand 74. As the lift frame 24 pivots, the toggle link 124 moves upwardly. Upward movement of the toggle link 124 allows the bias of the spring 78 on the stand 74 to pivot the stand 74 counterclockwise (as viewed in FIG. 4B) to the retracted position. Once the holes 92, 94, 156, 158 are aligned, the operator switches the switch 164 to stop extension of the hydraulic cylinder 70. At this point the toggle link 124 is out of contact with the stand 74. The operator activates the lever 102, i.e. moves it with a hand or a foot, to the latched position to move the latch pins 100 outwardly through holes 94, 148, 92, and 146 in that order, thereby removably securing the plow frame 20 to the mount frame 30 (FIGS. 2D, 5D). As the lever 102 is moved to the latched position, the connecting rod 120 toggles the toggle link 124 out of vertical alignment with the stand 74 and to its stowed position (FIGS. 2E, 4D, 5E, and 6C). This prevents the toggle link 124 from contacting the stand 74 during upward pivoting of the A-frame 22 and blade 32 thus preventing inadvertent movement of stand 74 to the extended position. At this time spring biased locking pin 111 carried by lever 102 can be positioned in hole 113 in plate 115 to lock the lever 102 in place.

Unhitching the plow frame 20 from the mount frame 30 is essentially the reverse of the above. The truck is parked and the hydraulic cylinder 70 is retracted to lower the plow blade 32 until it is supported on the ground or pavement. The operator disembarks from the truck and walks to a position alongside the plow frame 20, switches switch 162 to disable the in-cab plow controls, and switches switch 164 to extend the hydraulic cylinder 70 slightly thereby pivoting the lift frame 24 slightly clockwise (as viewed in FIG. 4B) to de-load the latch pins 100 in the holes 94, 148, 92, and 146. The operator then releases the locking pin 111 and moves the lever 102 in the opposite direction to the unlatched position thereby moving the latch pins 100 inwardly through holes 146, 92, 148, and 94 in that order. Movement of the lever 102 to the unlatched position toggles the toggle link 124 to its deployed position. The operator switches the switch 164 to retract the hydraulic cylinder 70 pivoting the lift frame 24 counterclockwise (as viewed in FIG. 4B) until the hitch pins 152 in the receivers 140 are clear of the recesses 88 in the arms 80. As the lift frame 24 pivots, the toggle link 124 moves downwardly and contacts stand 74, whereupon further pivoting of lift frame 24 causes the toggle link 124 to pivot the stand clockwise (as viewed in FIG. 4B) to the extended position against the bias of the spring 78. Once the stand 74 is supporting the plow frame 20 on the ground or pavement, the operator switches the switch 164 to stop the hydraulic cylinder from retracting, disconnects the truck electrical system from the plow electrical system and backs away from the plow frame 20.

As shown in FIGS. 2A-2E, 4A-4D, 5A-5E, and 6A-6C, the plow frame 20 and mount frame 30 are generally aligned vertically relative to one another in that hitch pins 152 are generally the same height as flats 86. In the event that the plow frame 20 is lower than that shown in FIGS. 2A-2E, 4A-4D, 5A-5E, and 6A-6C, structure is provided to raise the plow frame 20 relative to the mount frame 30 during initial contact of mount frame 30 with plow frame 20 so that hitch pins 152 are nonetheless received in recesses 88. More particularly, and referring to FIGS. 1, 2A, 3, 4A, and 5A, each arm 80 includes a guide plate 81 positioned between plates 82, 84 (FIGS. 2A, 3, 4A). Each guide plate 81 includes a downwardly and forwardly sloping generally planar section 83 having a transversely tapered free end 85, and a curved section 87 that generally matches the curvature of recess 88 and which curves above and partially forwardly around recess 88. In the event that the plow frame 20 is lower than that shown in FIGS. 2A-2E, 4A-4D, 5A-5E, and 6A-6C, hitch pins 152 will strike planar sections 83 and as the vehicle moves forwardly, continued forward movement of pins 152 will cam plates 83 upwardly until the pins 152 reach the recesses 88 at which time the plow frame 20 will drop such that the pins 152 are received in the recesses 88. In addition, the transversely tapered free end 85 of each guide plate 81 helps to position the plates 81 between their respective receiver plates 144, 146 in the event that there is any transverse misalignment between the plow frame 20 and mount frame 30.

Figure 7:
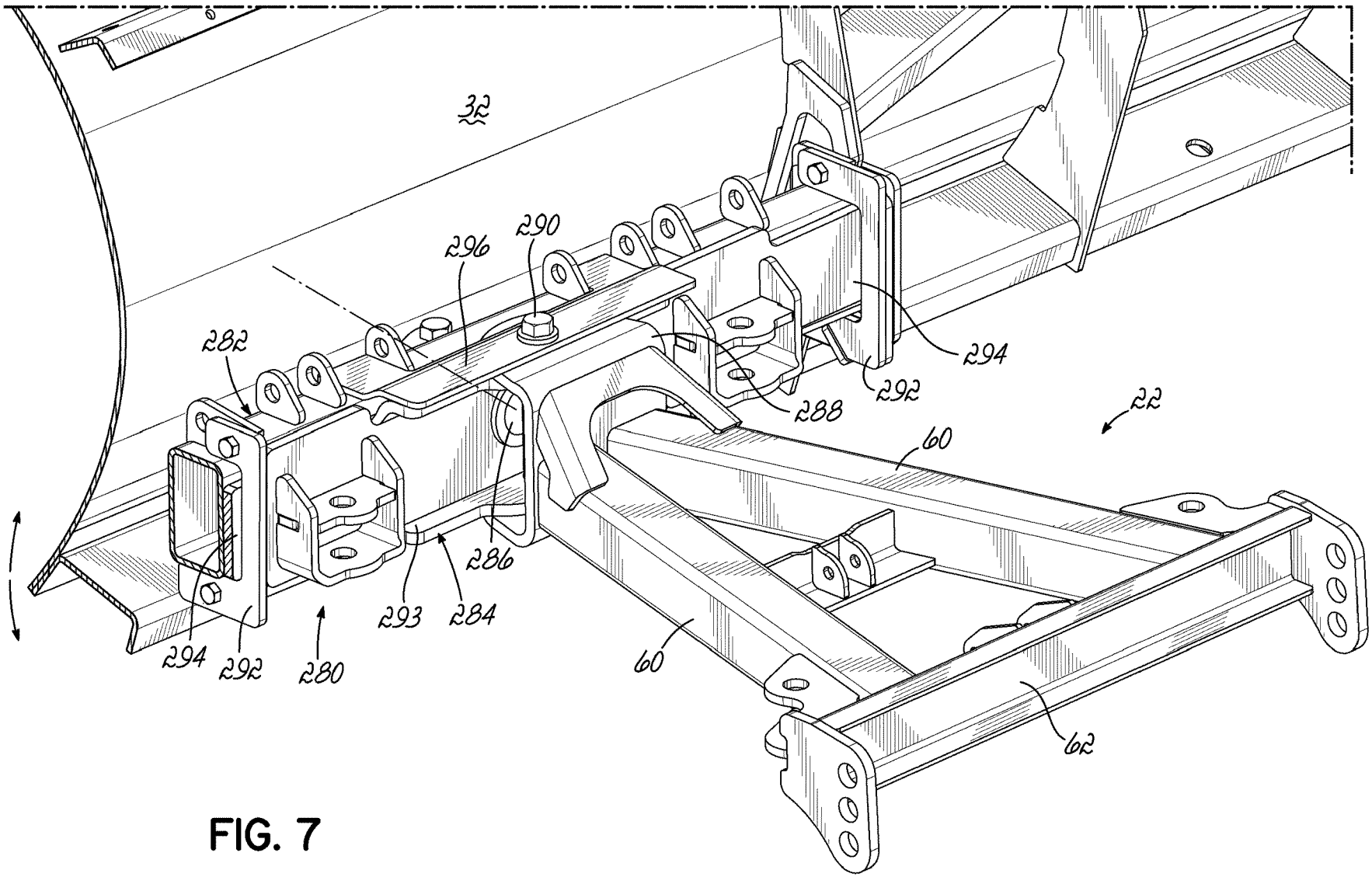
FIG. 7 is a rear perspective view of a two part push beam pivotally connecting the plow blade to the A-frame for pivoting movement about a generally longitudinal horizontal axis.

Referring now to FIG. 7, and with like numbers representing like elements, another feature of the snow plow of the present invention may be seen. A two part push beam or articulating quadrant 280 mounts plow blade 32 to A-frame 22. Two part push beam 280 has a forward portion 282 and a rearward portion 284. Forward push beam portion 282 as illustrated is essentially a box section or box beam. Rearward push beam portion 284 as illustrated is essentially a rearwardly facing C-section 293 with a plate 294 on either end of the C-section, the plates 294 oriented such that their plane is in a generally vertically plane. Plow blade 32 is pivotally connected to forward push beam portion 282 for pivoting movement about the aforementioned generally transverse horizontal trip axis. The forward and rearward push beam portions 282, 284 are pivotally connected at 286 for pivoting movement about a generally longitudinal horizontal axis. The rearward push beam portion 284 is pivotally connected to the clevis 288 of the A-frame 22 at 290 for pivoting movement about the aforementioned generally vertical axis. The flanges of the C-section 293 of the rearward push beam portion 284 are positioned or otherwise received in the clevis 288. To limit the amount of pivotal movement of the forward and rearward push beam portions 282, 284 relative to one another, C-shaped brackets 292 are mounted to either end of the forward push beam portion 282 which capture the plate ends 294 of rearward push beam portion 284. The brackets 292 and ends 294 can be designed so as to allow about 3-10 degrees of relative pivotal movement between the forward and rearward push beam portions 282, 284. This feature allows the blade 32 to pivot about the generally longitudinal horizontal axis relative to the A-frame 22, lift frame 24, and truck to better follow contours in the road surface being plowed. A resilient member, for example spring, for example leaf spring 296 overlying an upper edge of both of the push beam portions 282, 284, can be added to the assembly to add a degree of stiffness to the pivot connection 286. This helps to prevent tipping of the A-frame 22 and lift frame 24 when the plow frame 20 is parked on uneven ground or pavement, as well as helps to prevent tipping of the blade 32 during transit of the plow frame 20 by the truck. Other types of resilient members could be used to add a degree of stiffness to the pivot connection 286, for example torsion springs, tension springs, compression springs, rubbers, plastics, etc.

More particularly, a plow of the type shown herein has a single centered support stand. When a two part pivoting push beam of the type just described is added to the plow frame to allow the plow blade to better follow the contours of the road surface being plowed, the plow frame can become unstable when it is not attached to the truck and when it is parked on unlevel ground or pavement. The lift frame tends to tip to one side or the other, making it difficult to reattach the plow to the truck without the help of a second person. Also, if the plow frame to which the two part pivoting push beam is added is of the type having a lift arm pivoted to the lift frame, a hydraulic cylinder connected to the lift arm and to the lift frame, and a single chain connected to the free end of the lift arm and to the A-frame, the blade may tip to one side or the other when the A-frame and blade are in the raised position and are being transported by the truck. In both instances, the spring adds a degree of torsional stiffness to the pivot connection, thereby helping to prevent the A-frame and lift frame from tipping to one side if the snow plow is parked on even ground or pavement, and helping prevent the plow blade from potentially dragging on the ground or pavement during transit.

Note that the forward portion 282 of the two part push beam or articulating quadrant 280 could be incorporated into the structure of the blade 32, or the supporting frame and rib structure to which the blade moldboard is attached. In other words, the forward portion 282 of the two part push beam or articulating quadrant 280 could be a part of the blade 32 itself, and still be within the scope of the invention.

Figure 8:
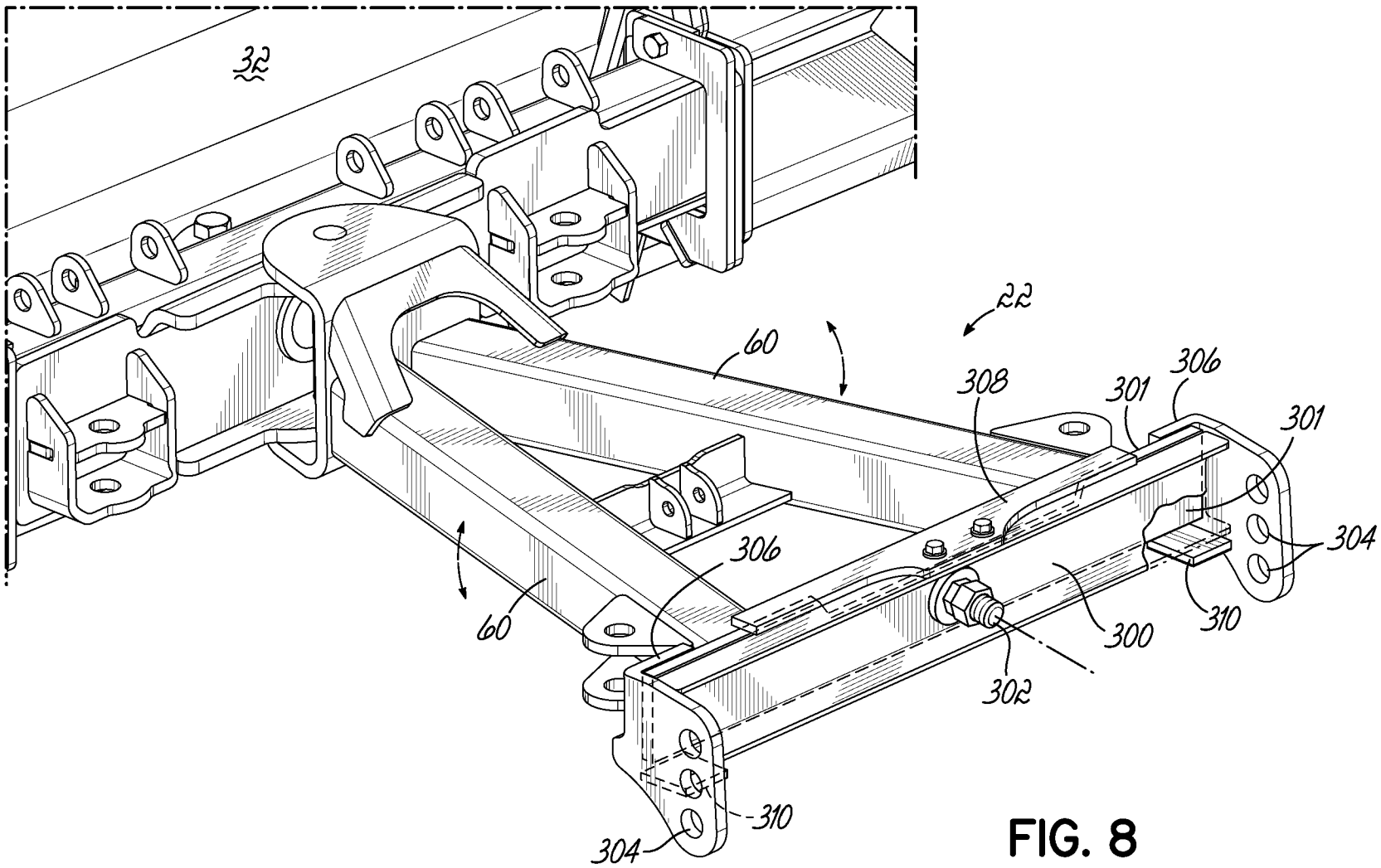
FIG. 8 is a rear perspective view of a trunnion pivotally connecting the A-frame to the lift frame for pivoting movement about the generally longitudinal horizontal axis.

Referring now to FIG. 8, and with like numbers representing like elements, another feature of the snow plow of the present invention may be seen. It is known to provide a pivot beam or trunnion 300 between the A-frame 22 and lift frame 24, with the rearward transverse member 301 of the A-frame 22 and the trunnion 300 pivotally connected at 302 for pivoting movement about the generally longitudinal horizontal axis, and with the trunnion 300 and lift frame 24 pivotally connected at 304 for pivoting movement about the generally transverse horizontal lift axis, per the assignee's U.S. Pat. No. 6,928,757, to allow the blade 32 to pivot about the generally longitudinal horizontal axis relative to the lift frame 24 and truck to better follow contours in the road surface being plowed. As illustrated, transverse member 301 differs from the previously described transverse member 62 in that transverse member 301 is essentially an elongated flat plate, whereas the trunnion or pivot beam 300 is shaped generally along the lines of the previously described transverse member 62. The trunnion 300 can include an ear 306 on each end that extends around and in front of each end of the transverse member 301. The improvement herein is the addition of a resilient member, for example a spring, for example a leaf spring 308 overlying an upper edge of both the transverse member 301 of the A-frame 22 and the trunnion 300, to add a degree of stiffness to the pivot connection 302. This helps to prevent the type of problems described above, namely tipping of the lift frame 24 when the plow frame 20 is parked on uneven ground or pavement, and tipping of the blade 34 during transit of the plow frame 20. Other types of resilient members could be used to add a degree of stiffness to the pivot connection 302, for example torsion springs, tension springs, compression springs, rubbers, plastics, etc. Rotational stops or limits similar to those provided in the two part push beam/articulating quadrant 280 described above can also be provided for the trunnion 300. For example, a plate 310 can be welded to the bottom of each end of the trunnion 300; the plates 310 would then be in a position to limit the relative rotation of the trunnion 300 relative to the transverse member 301 in that one of the plates 310 would strike the bottom edge of one end of the transverse member 301 when pivoting in one direction, and the other of the plates 310 would strike the bottom edge of the other end of the transverse member 301 when pivoting in the other direction. As with the two part push beam/articulating quadrant 280 described above, the trunnion 300, transverse member 301, and plates 310 can be designed so as to allow about 5-10 degrees of relative pivotal movement between the trunnion 300 and transverse member 301.

Referring now to FIGS. 9A-G, an alternative embodiment of support stand is illustrated. Support stand 200 is pivoted to plate 202 at 204. Support stand includes a curved cam surface 206 that cooperates with a cam actuating pin (or cylindrical roller, etc.) 208 mounted for transverse translational movement in bracket 210. Plate 202 is mounted to A-frame 22, and bracket 210 is mounted to lift frame 22. A link 212 is pivotally connected on one end to one of the latch pins 100 and is pivotally connected on the other end to a portion of a generally T-shaped lever 214, in particular to the end of one leg 216 of T-shaped lever 214; the other leg 218 of T-shaped lever 214 is pivotally connected on the end to the other latch pin 100. Another link 220 is fixedly connected on one end to the link 212 intermediate the ends of link 212, and is pivotally connected on the other end to the cam actuating pin 208.

Figure 9A:
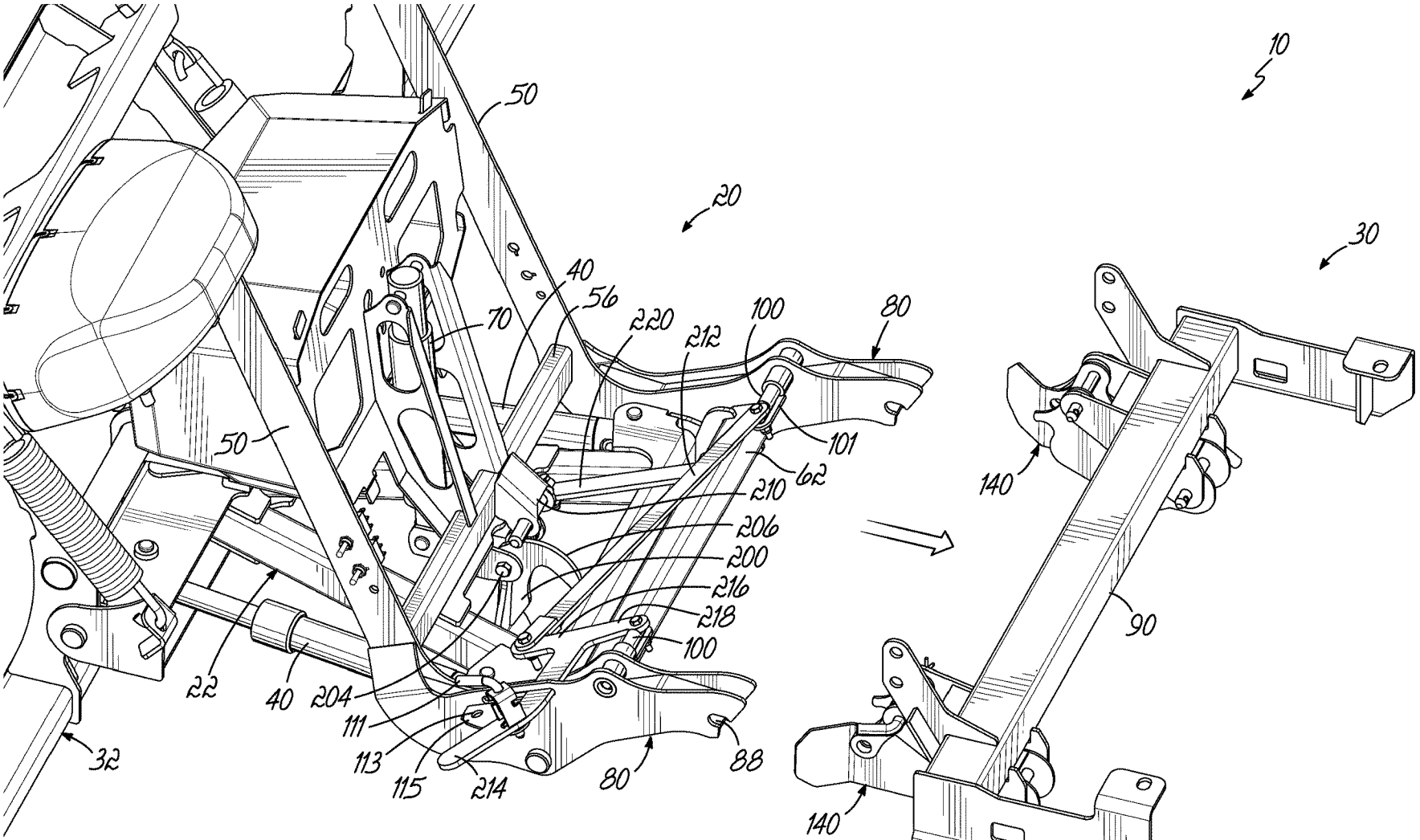
FIGS. 9A-9G are left rear perspective views of an alternative embodiment of snow plow and mount assembly of the present invention in various stages of hitching the snow plow frame to the mount frame, FIGS. 9C-9E being longitudinal sectional views thereof, with FIG. 9C showing the snow plow and mount assembly in the same position as FIG. 9B, and with FIG. 9F showing the snow plow and mount assembly in the same position as FIG. 9E.
Figure 9B:
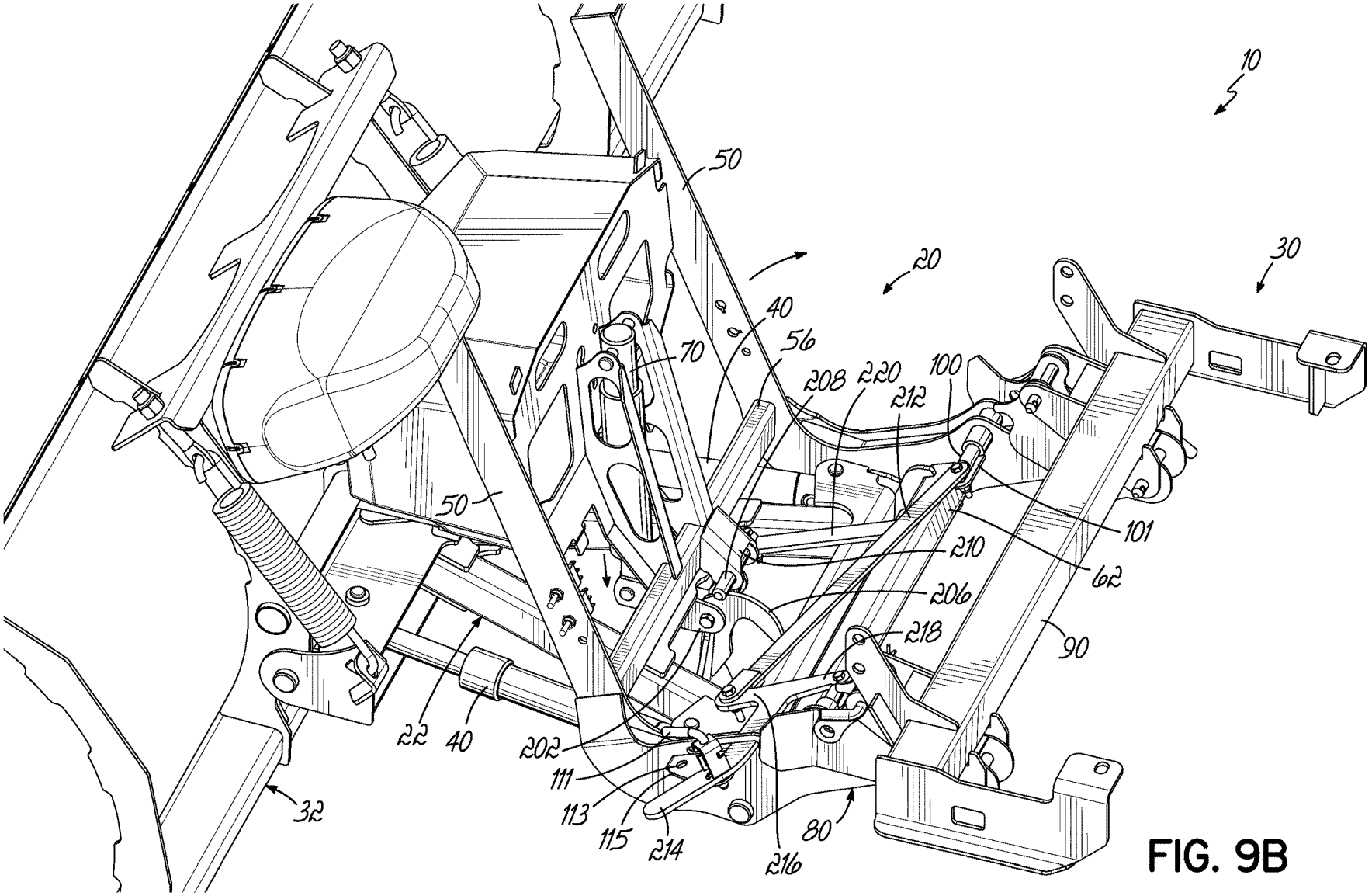
Figure 9C:
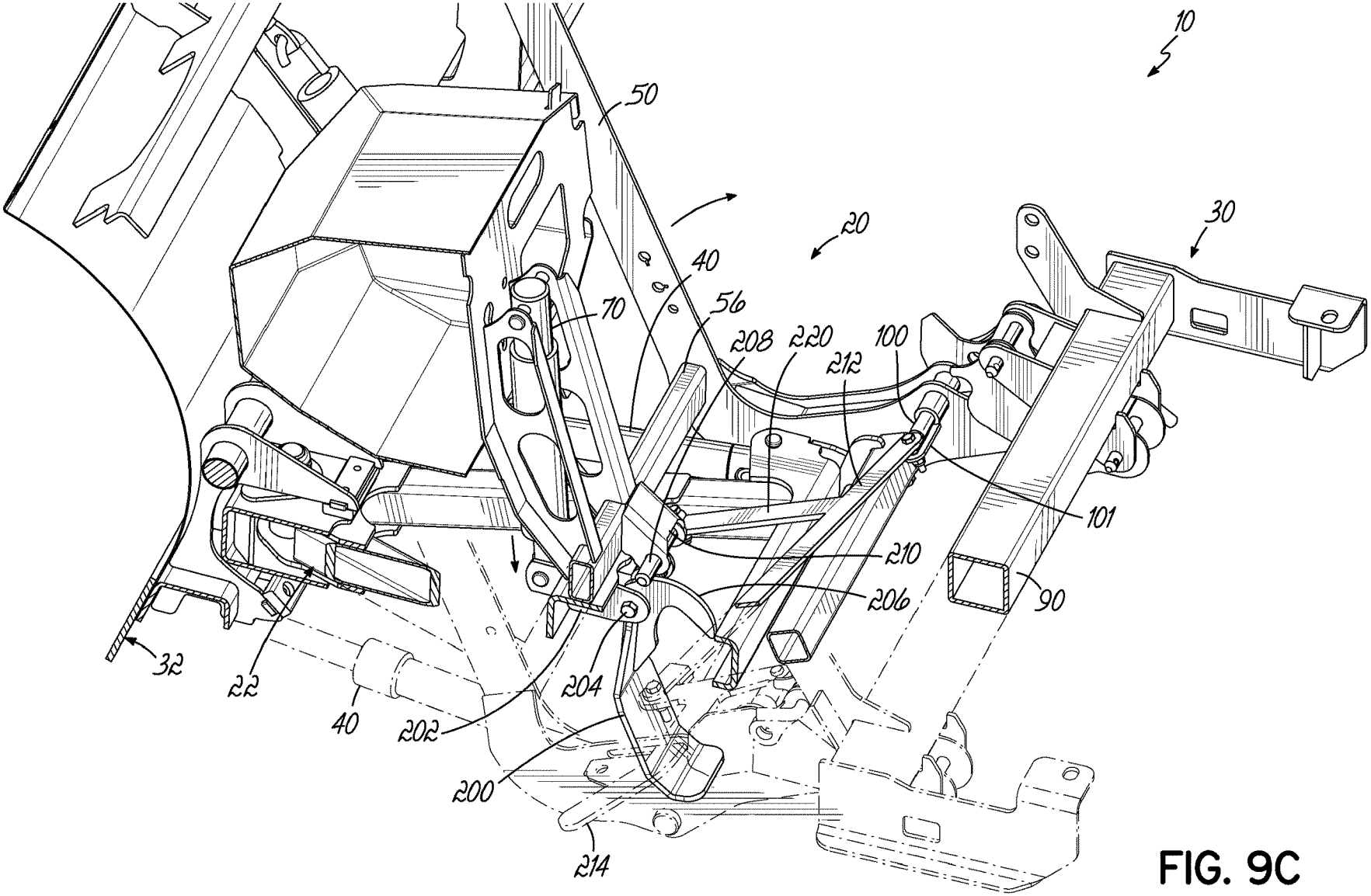
Figure 9D:
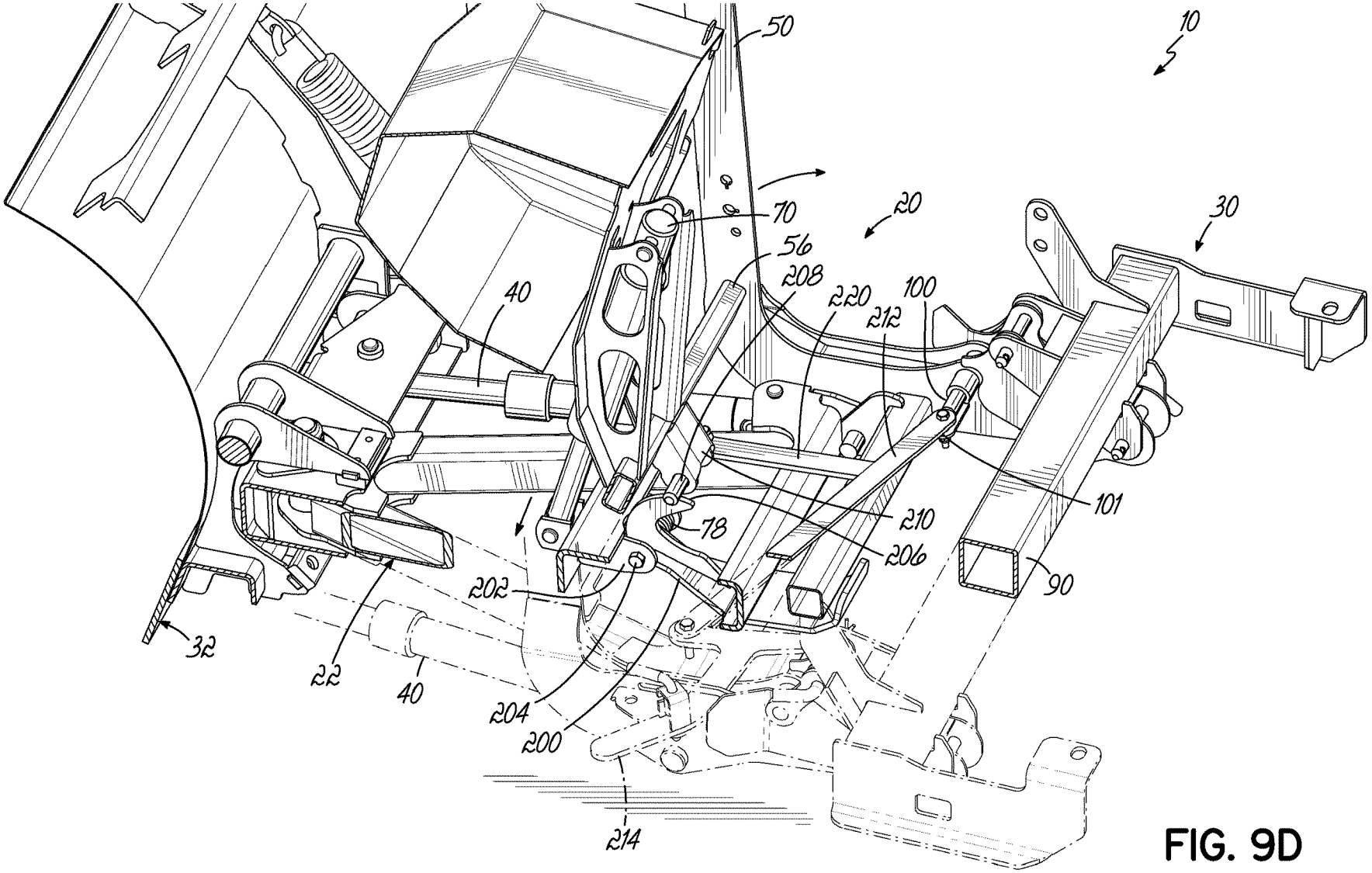
Figure 9E:
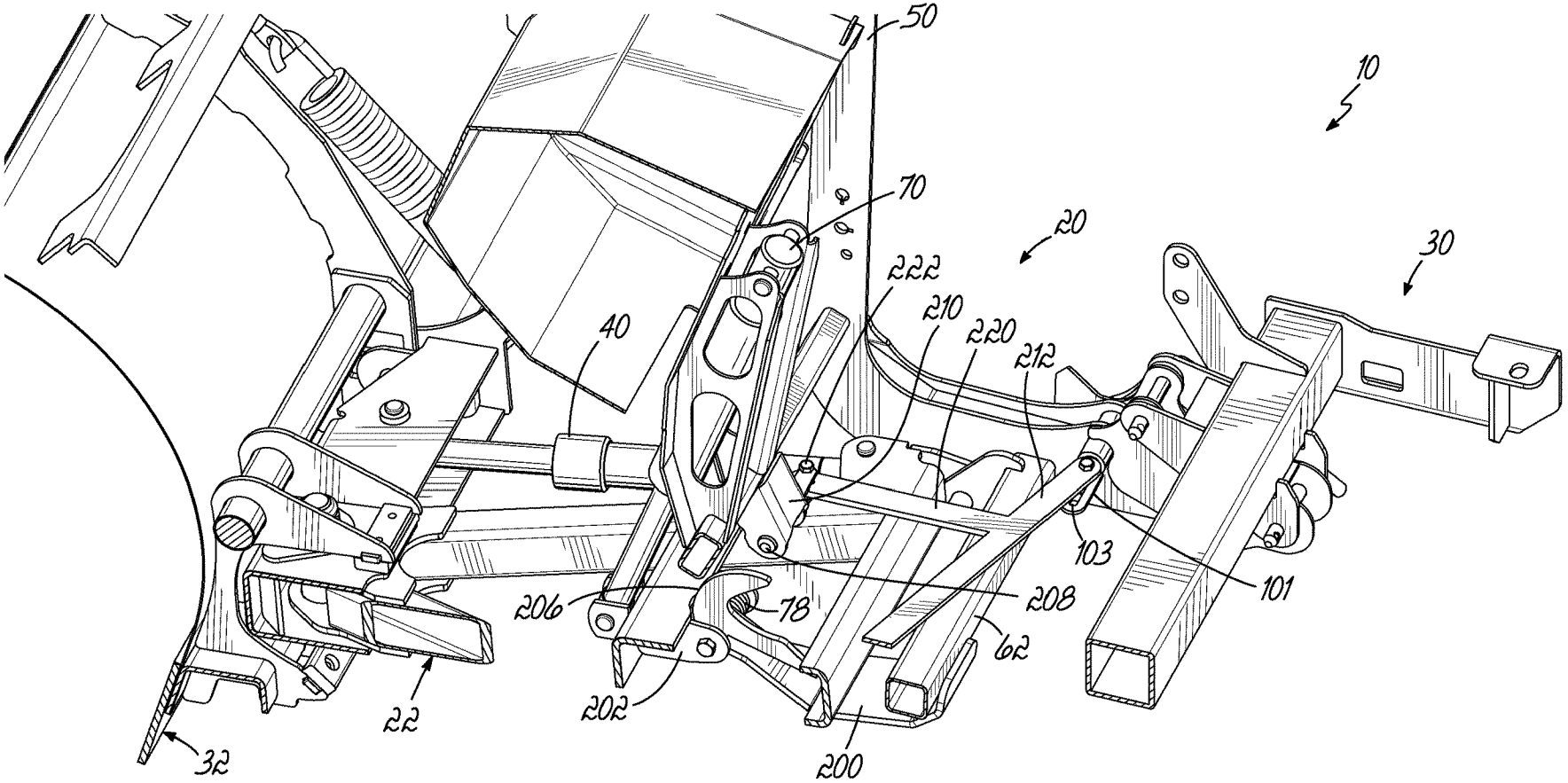
Figure 9F:
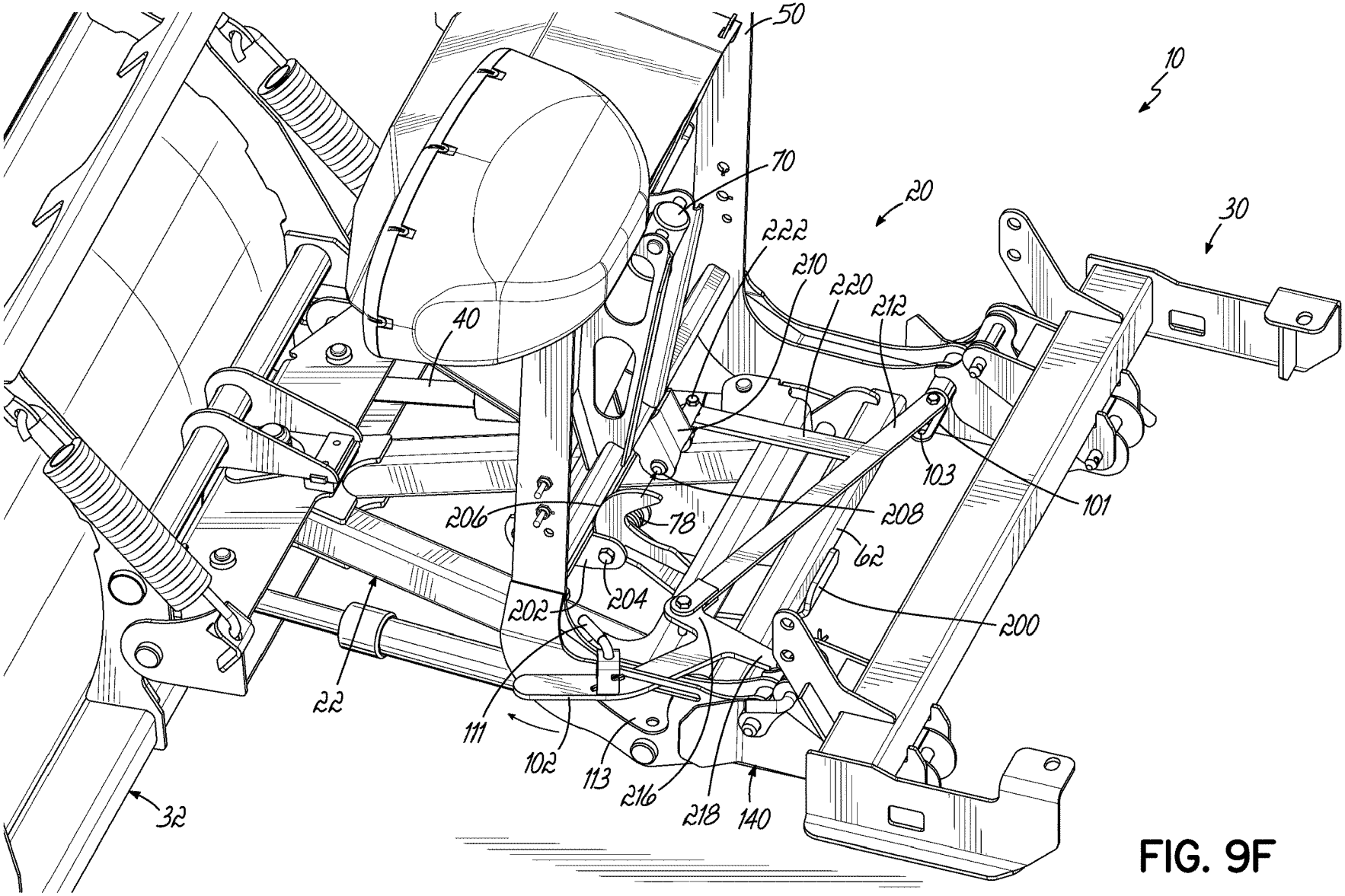
Figure 9G:
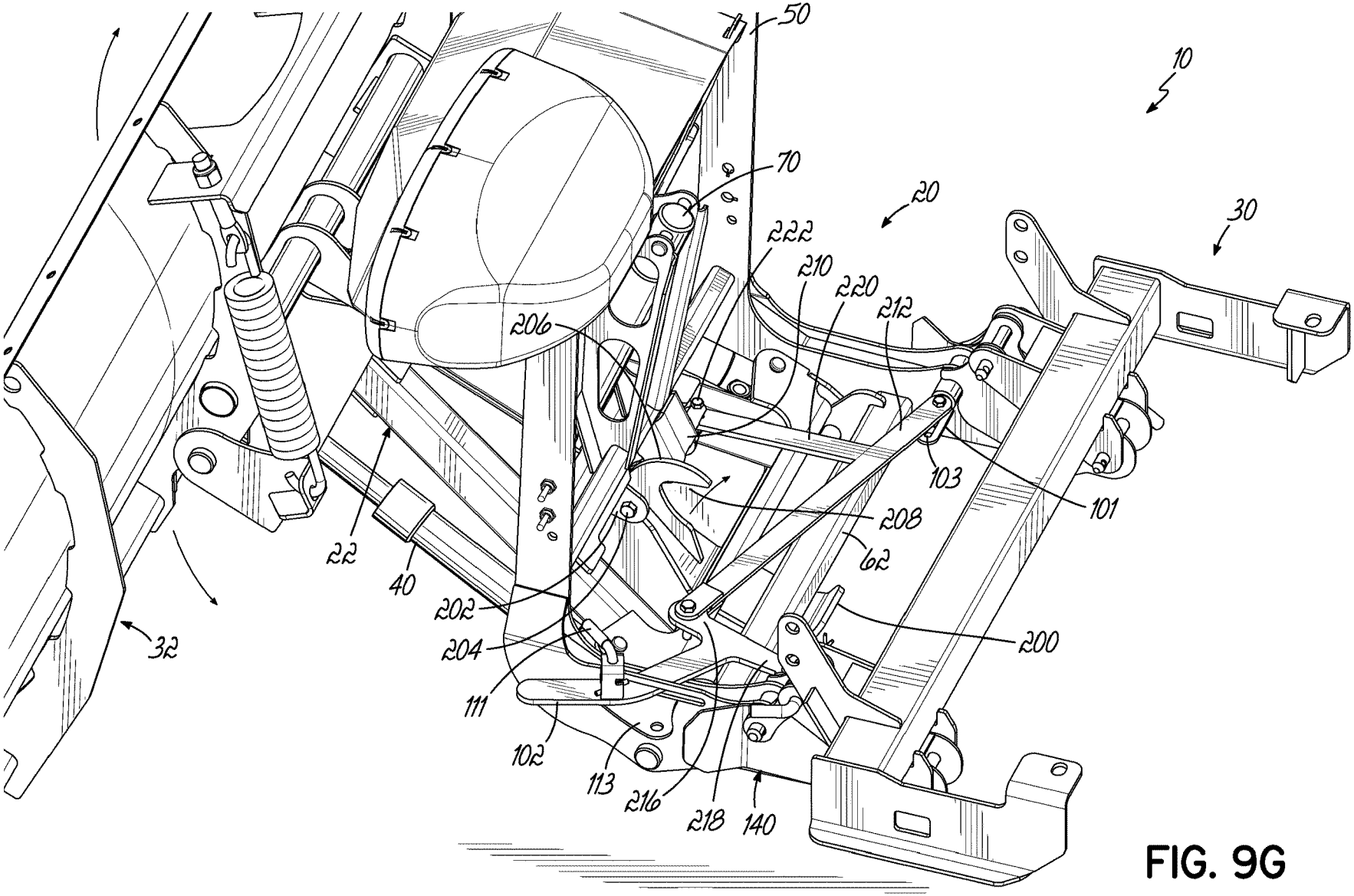

Referring still to FIGS. 9A-9G, hitching of the mount frame 30 to the snow plow frame 20 and operation of the alternative embodiment support stand 200 will be explained. With the plow frame 20 supported by stand 200 and with the mount frame 30 mounted on the truck, an operator drives the truck towards the plow frame 20 such that arms 80 are received in receivers 140, and further until such time as the hitch pins 152 in receivers 140 strike the flats 86 on the arms 80 (FIGS. 9A-9C). The operator disembarks from the truck and walks to a position alongside the plow frame 20 and connects the truck electrical system to the plow electrical system. The operator switches switch 162 to disable the in-cab plow controls, and switches switch 164 to extend the hydraulic cylinder 70 pivoting the lift frame 24 clockwise (as viewed in FIG. 9B) until the hitch pins 152 in the receivers 140 are received in the recesses 88 in the arms 80, and further until the holes 92, 94 in the plates 82, 84 of the arms 80 are aligned with the holes 156, 158 in the plates 146, 148 of the receivers 140 (FIGS. 9A-9D). Initially the cam actuating pin 208 is in its deployed position, in contact with the cam surface 206 of stand 200. As the lift frame 24 pivots, the cam actuating pin 208 moves upwardly. Upward movement of the cam actuating pin 208 allows the bias of the spring 78 on the stand 200 to pivot the stand 200 counterclockwise (as viewed in FIGS. 9B-9G) to the retracted position. Once the holes 92, 94, 156, 158 are aligned, the operator switches the switch 164 to stop extension of the hydraulic cylinder 70. At this point the cam actuating pin 208 is out of contact with the cam surface 206 of stand 200. The operator activates the lever 214, i.e. moves it with a hand or a foot, to the latched position to move the latch pins 100 outwardly through holes 94, 148, 92, and 146 in that order, thereby removably securing the plow frame 20 to the mount frame 30 (FIGS. 9D-9G). As the lever 214 is moved to the latched position, the link 220 pulls the cam actuating pin 208 towards the passenger side of the plow frame 20, out of vertical alignment with the stand 200, and to its stowed position (FIGS. 9D-9G). This prevents the cam actuating pin 208 from contacting the cam surface 206 of the stand 200 during upward pivoting of the A-frame 22 and blade 32 thus preventing inadvertent movement of stand 200 to the extended position. At this time spring biased locking pin 111 carried by lever 214 can be positioned in hole 113 in plate 115 to lock the lever 214 in place.

Unhitching the plow frame 20 from the mount frame 30 is essentially the reverse of the above. The truck is parked and the hydraulic cylinder 70 is retracted to lower the plow blade 32 until it is supported on the ground or pavement. The operator disembarks from the truck and walks to a position alongside the plow frame 20, switches switch 162 to disable the in-cab plow controls, and switches switch 164 to extend the hydraulic cylinder 70 slightly thereby pivoting the lift frame 24 slightly clockwise (as viewed in FIGS. 9A-9G) to de-load the latch pins 100 in the holes 94, 148, 92, and 146. The operator then releases the locking pin 111 moves the lever 214 in the opposite direction to the unlatched position thereby moving the latch pins 100 inwardly through holes 146, 92, 148, and 94 in that order. Movement of the lever 214 to the unlatched position pushes the cam actuating pin 208 toward the driver side of the plow frame 20 to its deployed position. The operator switches the switch 164 to retract the hydraulic cylinder 70 pivoting the lift frame 24 counterclockwise (as viewed in FIGS. 9A-9G) until the hitch pins 152 in the receivers 140 are clear of the recesses 88 in the arms 80. As the lift frame 24 pivots, the cam actuating pin 208 moves downwardly and contacts cam surface 206 of stand 200, whereupon further pivoting of lift frame 24 causes the cam actuating pin 208 to pivot the stand 200 clockwise (as viewed in FIGS. 9A-9G) to the extended position against the bias of the spring 78. Once the stand 200 is supporting the plow frame 20 on the ground or pavement, the operator switches the switch 164 to stop the hydraulic cylinder from retracting, disconnects the truck electrical system from the plow electrical system and backs away from the plow frame 20.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, an actuator operably associated with said A-frame and said lift frame for imparting relative pivoting movement between said A-frame and said lift frame, one of said mount frame and said lift frame having first and second arms and the other of said mount frame and said lift frame having first and second receivers, said first and second arms received in respective ones of said first and second receivers upon relative movement therebetween toward one another, a trunnion, said trunnion and A-frame pivotally connected to one another for pivoting movement about a generally longitudinal horizontal axis, said lift frame and said trunnion pivotally connected to one another for pivoting movement about the generally transverse horizontal axis, and a resilient member operably associated with said pivotal connection of said trunnion and said A-frame to impart a degree of stiffness to said pivotal connection, said assembly further comprising:

a support stand pivotally connected to said A-frame for pivoting movement to an extended ground contacting and snow plow frame supporting position and to a retracted position at which said stand does not contact the ground and does not support said snow plow frame, said support stand biased toward the retracted position, a link pivotally connected to said lift frame for pivoting movement between a deployed position and a stowed position, and said lift frame having first and second latch pins movable to a latched position where respective ones of said latch pins secure said first and second arms in said first and second receivers, and movable to an unlatched position where said arms are free to move out of said receivers, said link operably associated with said stand and said latch pins operably associated with said link such that, when said latch pins are moved to the unlatched position said link moves to the deployed position, and when said actuator is energized to pivot said lift frame relative to said A-frame in one direction said link contacts said support stand whereupon further pivoting of said lift frame relative to said A-frame in the one direction moves said support stand to the deployed position, and when said actuator is energized to pivot said lift frame relative to said A-frame in the other direction said support stand returns to the retracted position, and when said latch pins are moved to the latched position said link moves to the stowed position.

2. The assembly of claim 1 wherein said resilient member is a leaf spring.

3. The assembly of claim 1 wherein said trunnion and said A-frame include cooperating limit structure for limiting a magnitude of pivoting movement that said A-frame can pivot relative to said trunnion.

4. The assembly of claim 1 wherein said arms are on said lift frame and said receivers are on said mount frame.

5. The assembly of claim 1 wherein said actuator is a hydraulic cylinder connected to said A-frame and to said lift frame.

6. The assembly of claim 1 further comprising a lever for moving said latch pins and a linkage mechanism interconnecting said latch pins, said lever, and said link.

7. The assembly of claim 1 wherein said a plow blade is also pivotally connected relative to said A-frame for pivoting movement about the generally longitudinal horizontal axis, and further comprising:

a two part push beam having a forward portion and a rearward portion, said blade mounted to said forward push beam portion, said rearward push beam portion pivotally connected to said A-frame for pivoting movement about the generally vertical axis, said forward and rearward push beam portions pivotally connected to one another for pivoting movement about the generally longitudinal horizontal axis, and a resilient member operably associated with said pivotal connection of said forward push beam portion to said rearward push beam portion to impart a degree of stiffness to said pivotal connection.

8. The assembly of claim 7 wherein said resilient member is a leaf spring.

9. The assembly of claim 7 wherein said forward and rearward push beam portions include cooperating limit structure for limiting a magnitude of pivoting movement that said forward push beam portion can pivot relative to said rearward push beam portion.

10. A snow plow and mount assembly comprising:

a mount frame adapted to be secured to a vehicle, a snow plow frame having an A-frame and a lift frame pivotally connected relative to one another for pivoting movement about a generally transverse horizontal axis, a plow blade pivotally connected relative to said A-frame for pivoting movement about a generally vertical axis, an actuator operably associated with said A-frame and said lift frame for imparting relative pivoting movement between said A-frame and said lift frame, one of said mount frame and said lift frame having at least a first arm and the other of said mount frame and said lift frame having at least a first receiver, said arm received in said receiver upon relative movement therebetween toward one another, a trunnion, said trunnion and A-frame pivotally connected to one another for pivoting movement about a generally longitudinal horizontal axis, said lift frame and said trunnion pivotally connected to one another for pivoting movement about the generally transverse horizontal axis, and a resilient member operably associated with said pivotal connection of said trunnion and said A-frame to impart a degree of stiffness to said pivotal connection, said assembly further comprising:

a latch pin movable to a latched position where said at least a first arm is secured in said at least a first receiver, and movable to an unlatched position where said at least a first arm is free to move out of said at least a first receiver, a support stand pivotally connected to said A-frame for pivoting movement to an extended ground contacting and snow plow frame supporting position and to a retracted position at which said stand does not contact the ground and does not support said snow plow frame, said support stand biased toward the retracted position, and a cam actuating pin movably connected to said lift frame for translational movement between a deployed position and a stowed position, said cam actuating pin operably associated with a cam surface of said stand and a lever operably associated with said cam actuating pin and said latch pin, such that, when said lever is moved to move said latch pin to the unlatched position said cam actuating pin moves to the deployed position, and when said actuator is energized to pivot said lift frame relative to said A-frame in the second direction said cam actuating pin contacts said cam surface of said stand whereupon further pivoting of said lift frame relative to said A-frame in the second direction moves said support stand to the deployed position, and when said actuator is energized to pivot said lift frame relative to said A-frame in the first direction said support stand returns to the retracted position, and when said lever is moved to move said latch pin to the latched position said cam actuating pin moves to the stowed position.

11. The snow plow assembly of claim 10 further comprising a linkage mechanism interconnecting said latch pin, said lever, and said cam actuating pin.

12. The assembly of claim 10 further comprising:

a hole in said at least a first arm and a corresponding hole in said at least a first receiver, for said latch pin, such that when said actuator is energized to pivot said lift frame relative to said A-frame in the first direction said arm hole is aligned with said receiver hole, at which time said lever is moved to move said latch pin to the latched position thereby positioning said latch pin in said arm hole and in said receiver hole.

* * * * *